US010727571B2

(12) United States Patent
Vollmer et al.

(10) Patent No.: US 10,727,571 B2
(45) Date of Patent: Jul. 28, 2020

(54) CELLULAR RADIO ANTENNA

(71) Applicant: KATHREIN SE, Rosenheim (DE)

(72) Inventors: Andreas Vollmer, Rosenheim (DE); Max Goettl, Frasdorf (DE)

(73) Assignee: KATHREIN SE, Rosenheim (DE)

( * ) Notice: Subject to any disclaimer, the term of this patent is extended or adjusted under 35 U.S.C. 154(b) by 134 days.

(21) Appl. No.: 15/445,246

(22) Filed: Feb. 28, 2017

(65) Prior Publication Data

US 2017/0256847 A1 Sep. 7, 2017

(30) Foreign Application Priority Data

Mar. 3, 2016 (DE) ..... 10 2016 002 588

(51) Int. Cl.

| | |
|---|---|
| ***H01Q 1/24*** | (2006.01) |
| ***H01Q 19/10*** | (2006.01) |
| ***H01Q 21/06*** | (2006.01) |
| ***H01Q 21/24*** | (2006.01) |
| ***H01Q 19/09*** | (2006.01) |
| ***H01Q 9/28*** | (2006.01) |
| ***H01Q 1/52*** | (2006.01) |
| ***H01Q 15/08*** | (2006.01) |
| *H01Q 21/22* | (2006.01) |

(52) U.S. Cl.

CPC ..... *H01Q 1/246* (2013.01); *H01Q 1/521* (2013.01); *H01Q 9/285* (2013.01); *H01Q 15/08* (2013.01); *H01Q 19/09* (2013.01); *H01Q 19/108* (2013.01); *H01Q 21/062* (2013.01); *H01Q 21/24* (2013.01); *H01Q 21/22* (2013.01)

(58) Field of Classification Search

CPC ..... H01Q 1/246; H01Q 1/521; H01Q 9/285; H01Q 15/08; H01Q 19/09; H01Q 19/108; H01Q 21/062; H01Q 21/24; H01Q 21/22

See application file for complete search history.

(56) References Cited

U.S. PATENT DOCUMENTS

| | | | |
|---|---|---|---|
| 2,624,003 | A | 12/1952 | Iams |
| 4,011,566 | A | 3/1977 | Honda |

(Continued)

FOREIGN PATENT DOCUMENTS

| | | | |
|---|---|---|---|
| DE | 10064129 | A1 | 7/2002 |
| DE | 202004013971 | U1 | 8/2005 |
| DE | 102006036325 | A1 | 2/2008 |

OTHER PUBLICATIONS

Adamiuk, G. et al., "Compact, Dual-Polarized UWB-Antenna, Embedded in a Dielectric," IEEE Transactions on Antennas and Propagation, vol. 58, No. 2, Feb. 2010, First Published Dec. 4, 2009, 8 pages.

(Continued)

*Primary Examiner* — Dameon E Levi
*Assistant Examiner* — David E Lotter
(74) *Attorney, Agent, or Firm* — McCoy Russell LLP

(57) ABSTRACT

The present invention relates to a cellular radio antenna, in particular for a cellular radio base station, having at least one dipole radiator and having a dielectric body that is arranged on the dipole radiator and characterized in that the height H of the dielectric body in the main radiation direction amounts to at least 30% of the maximum thickness D of the dielectric body in a cross-section perpendicular to the main radiation direction.

19 Claims, 22 Drawing Sheets

(56) References Cited

U.S. PATENT DOCUMENTS

| | | | | |
|---|---|---|---|---|
| 2003/0011529 | A1 | 1/2003 | Gottl | |
| 2018/0233815 | A1* | 8/2018 | Deng | H01Q 1/246 |

OTHER PUBLICATIONS

Leib, M. et al., "An Ultra-Wideband Dielectric Rod Antenna Fed by a Planar Circular Slot," IEEE Transactions on Microwave Theory and Techniques, vol. 59, No. 4, Apr. 2011, First Published Mar. 10, 2011, 8 pages.

Liu, J. et al., "New Method for Ultra Wide Band and High Gain Rectangular Dielectric Rod Antenna Design," Progress In Electromagnetic Research C, vol. 36, Jan. 2013, 13 pages.

Rousstia, M. et al., "High Performance 60-GHz Dielectric Rod Antenna with Dual Circular Polarization," Proceedings of European Microwave Week 2013, Oct. 6, 2013, Nuremberg, Germany, 4 pages.

Rousstia, M. et al., "Wideband Dual-Circularly-Polarized Dielectric Rod Antenna for Applications in V-band Frequencies," Proceedings of ICT.OPEN 2013, Nov. 27, 2013, Eindhoven, Netherlands, 6 pages.

* cited by examiner $$d_{max.Leiter} \approx \frac{\lambda}{\sqrt{1 \cdot .WAVEGUIDE-1)'}}$$

$$d_{min.Spitze} \approx \frac{\lambda}{\sqrt{2.5 \cdot .WAVEGUIDE-1)'}}$$

CELLULAR RADIO ANTENNA

CROSS-REFERENCE TO RELATED APPLICATION

The present application claims priority to German Patent Application No. 10 2016 002 588.3, entitled "MOBILE ANTENNA," filed on Mar. 3, 2016, the entire contents of which is hereby incorporated by reference in its entirety for all purposes.

TECHNICAL FIELD

The present invention relates to a cellular radio antenna having a dipole radiator and having a dielectric body arranged on the dipole radiator. The present invention furthermore relates to a cellular radio antenna arrangement having a plurality of antennas, having a first subgroup of first antennas and having a second subgroup of second antennas. It is in this respect in each case preferably a cellular radio antenna for use at a cellular radio base station.

BACKGROUND AND SUMMARY

The use of dielectric rod antennas has previously only been known from the field of radar technology.

A UWB antenna is thus known from the publication "Compact, dual polarized UWB antenna, embedded in a dielectric", Grzegorz Adamiuk et al., IEEE transactions on antennas and propagation, Volume 56, No. 2, February 2010, in which a dual-polarized antenna composed of two slot radiators is arranged in a dielectric body in the form of a cone.

The publication "An ultra-wideband dielectric rod antenna fed by a planar circular slot", Mario Leib et al., IEEE transactions on microwave theory and techniques, Vol. 59, No. 4, pages 1028-1089, April 2011, likewise shows a UWB antenna having a dielectric rod antenna that is fed by a slot radiator.

The publications "Wideband Dual-Circularly-Polarized Dielectric Rod Antenna for Applications in V-band Frequencies", M. W. Rousstia et al., Proceedings of ICT.OPEN 2013, 27-28 Nov. 2013, Eindhoven, Eindhoven Technical University, 2013, "High performance 60-GHz dielectric rod antenna with dual circular polarization, M. W. Rousstia et al., Proceedings of the 10th European Radar Conference, (EuRAD), Oct. 9-11, 2013, Nuremberg, IEEE, pages 359 to 362, and "NEW METHOD FOR ULTRA WIDE BAND AND HIGH GAIN RECTANGULAR DIELECTRIC ROD ANTENNA DESIGN", Jingping Liu et al., Progress In Electromagnetics Research C, Vol. 36, p. 131-143, 2013, likewise show the use of dielectric rod-like bodies in the field of radar technology.

In the cellular radio field, it is only known with group antennas composed of a plurality of dipole radiators to arrange thin dielectric plates of low relative permittivity on the individual dipole radiators.

Dielectric resonator antennas are furthermore known in the cellular radio field in which the dielectric body itself is used as the radiator that is typically fed via a slot.

It is the object of the present invention to improve the properties of cellular radio antennas and in particular their usability in cellular radio antenna arrangements having a high single radiator density.

This object is achieved in accordance with the invention by a cellular radio antenna having at least one dipole radiator and having a dielectric body arranged on the dipole radiator, wherein a height of the dielectric body in a main radiation direction amounts to at least 30% of a maximum thickness of the dielectric body in a cross-section perpendicular to the main radiation direction. Embodiments of the invention form the subject of the dependent claims.

The present invention shows in a first aspect a cellular radio antenna, in particular a cellular radio antenna for a cellular radio base station, having at least one dipole radiator and having a dielectric body arranged on the dipole radiator. The present invention is characterized in that the height H of the dielectric body in the main radiation direction amounts to at least 30% of the maximum thickness D of the dielectric body in a cross-section perpendicular to the main radiation direction.

The dielectric body acts as a waveguide for the cellular radio signals emitted by the dipole radiator due to the dimensioning in accordance with the invention and hereby displaces the radiation plane of the dipole radiator. The displacement of the radiation plane in particular means the changing and/or displacing of the effective radiator aperture and/or the displacement of the phase center of the radiation in the main radiation direction. This allows a plurality of new areas of application of the combination of dipole radiators and dielectric bodies, in particular in the field of cellular radio antenna arrangements having a plurality of antennas.

In this respect, the height H of the dielectric body preferably amounts to at least 50% of the maximum thickness D of the dielectric body; further preferably, in this respect, the height H of the dielectric body amounts to at least 70% of the maximum thickness D of the dielectric body. A correspondingly larger displacement of the radiation plane is hereby given.

In possible embodiments, the height H of the dielectric body can amount to more than 85% of the maximum thickness D of the dielectric body or even more than 150%. The height H of the dielectric body is at least not limited upwardly in principle. However, $H<6*D$ preferably applies, further preferably $H<3*D$, with respect to the intended application.

In this respect $H<3*D$ preferably applies to antennas having a horizontal full width half maximum between 55° and 100°, in particular to antennas having a horizontal full width half maximum of 65°+−10° or 90°+−10°. Alternatively or additionally, in this respect, $H<6*D$ and/or $H>2*D$ applies to antennas having a horizontal full width half maximum between 23° and 43°. The directivity effect of the dielectric body that increases with a larger height is hereby taken into account.

It is furthermore conceivable in beam-forming and/or beam-shaping applications in which a plurality of antennas can be flexibly connected to one another and/or can be operated separably, to use dielectric bodies having different heights for the individual antennas.

In accordance with the invention, the height H of the dielectric body is measured in the main radiation direction of the dipole radiator. The thickness D is measured in the cross-section of the dielectric body, i.e. in a plane perpendicular to the main radiation direction of the dipole radiator. The dielectric body in this respect does not have to have a symmetrical configuration. The longest extent of the dielectric body in the main radiation direction of the dipole radiator is considered as the height of the dielectric body and the longest extent in cross-section, i.e. in a plane perpendicular to said main radiation direction, is considered as the thickness of the dielectric body in a vertical plane. The maximum thickness D of the dielectric body is thus the largest thickness, viewed over all vertical planes, in a cross-section of the dielectric body.

The cellular radio antenna in accordance with the invention is preferably connectable to a cellular radio base station via signal lines to receive and/or to transmit cellular radio signals. In this respect, the cellular radio antenna in accordance with the invention can be used in a frequency band that is in the range between 100 MHz and 10 GHz, preferably between 500 MHz and 6 GHz. Alternatively or additionally, the antenna can have a resonant frequency range that is between 100 MHz and 10 GHz, preferably between 500 MHz and 6 GHz. In principle, higher frequencies are also conceivable, in particular when the dipole radiator is a printed circuit dipole.

The dielectric body in accordance with the invention can first be produced from any desired dielectric material. For example, the dielectric body can be produced from a homogeneous dielectric material. The dielectric body can, for example, in this respect be a solid plastic body.

Alternatively, the dielectric body can, however, also comprise a first material having a higher relative permittivity and a second material having a lower relative permittivity. For example, in this respect, the first material can be embedded in the second material as a granulate, or vice versa. Alternatively, the second material can be gaseous and can be embedded in bubble-form in the first material. Air bubbles can in this respect in particular be provided in the first material.

Independently of the material used, the dielectric body preferably has an effective relative permittivity $\varepsilon_r$ of more than 2, further preferably of more than 2.5. The effective relative permittivity $\varepsilon_r$ can in this respect, for example, be between 2 and 4, further preferably between 2.5 and 3.5.

For example, solid material having a relative permittivity in this range can be used in this respect or material having a higher relative permittivity and embedded air holes. Material having a higher relative permittivity can furthermore be embedded as a granulate in a material having a lower relative permittivity, for example.

The material of the dielectric body can in this respect have an approximately constant permittivity or a gradient of permittivity.

The dielectric body preferably has an axis of symmetry facing in the main radiation direction. A particularly uniform far-field diagram hereby results.

The symmetry is in this respect particularly preferably an axial symmetry and/or a rotational symmetry. The dielectric body is in this respect particularly preferably rotationally symmetrical with respect to an axis of symmetry aligned in the main radiation direction of the dipole radiator, i.e. it has a round cross-section. In this case, the maximum thickness D corresponds to the maximum diameter of a cross-section of the dielectric body.

Alternatively, the dielectric body can be axially symmetrical with respect to an axis of symmetry aligned in the main radiation direction of the dipole radiator, for example with a cross-sectional area in the form of a preferably regular polygon, for example of a quadrangle or a square. In this case, the maximum thickness D corresponds to the maximum diagonal of a cross-section of the dielectric body.

The dielectric body preferably has a rod region. The thickness of the dielectric body preferably differs in this rod region by a maximum of 30%, and further preferably by a maximum of 15%, from the maximum thickness D. In this respect, the largest extent of the dielectric body in a vertical plane is understood as the thickness of the dielectric body in said vertical plane. Alternatively or additionally, the cross-sectional area of the dielectric body preferably differs in the rod region by a maximum of 30%, and further preferably by a maximum of 15%, from the maximum cross-sectional area of the dielectric body.

The dielectric body preferably has a cross-section in every vertical plane, at least in the rod region, that comprises a circle or a preferably regular polygon, for example a quadrangle, a hexagon, an octagon, etc. In principle, however, any form having a waveguide function and/or aperture displacement function is conceivable.

The dielectric body particularly preferably has a thickness that is constant in the vertical direction and/or a cross-section that is constant in the vertical direction in the rod region. The rod region in particular has a cylindrical shape, preferably a circular cylindrical shape or parallelepiped shape.

The height of the rod region preferably amounts to between 50 and 100%, further preferably to between 65 and 100%, of the height H of the dielectric body.

Alternatively or additionally, the dielectric body can have a lens region. In the lens region, the dielectric body preferably has a cross-section varying in the vertical direction. The cross-sectional area of the dielectric body preferably varies in the lens region by at least 30% in the lens region and further preferably by at least 50% with respect to the maximum cross-sectional area of the dielectric body.

The lens region particularly preferably has the form of a truncated cone or of a truncated counter-cone or of a truncated pyramid or of a truncated counter-pyramid. The smallest diameter or the smallest diagonal of the truncated cone or counter-cone or of the truncated pyramid or counter-pyramid in this respect particularly preferably amounts to between 30 and 80% of the maximum diameter or of the maximum diagonal of the truncated cone or counter-cone or of the truncated pyramid or counter-pyramid, further preferably to between 40 and 70%.

The height of the lens region preferably amounts to between 5 and 50%, preferably to between 10 and 35%, of the height H of the dielectric body.

The dielectric body preferably has both a rod region and a lens region. The lens region is in this case preferably arranged on the side of the rod region remote from the dipole radiator. Alternatively, the dielectric body can only have a rod region with a cross-section varying slightly in the vertical direction.

Independently of the specific form of the dielectric body, the latter is preferably arranged in the main radiation direction on the dipole radiator. No dielectric body is further preferably provided in the region of the dipole radiator itself, i.e. the dipole radiator is not embedded in the dielectric body, but rather arranged on the dielectric body in the main radiation direction.

In this respect, in accordance with the invention, the dielectric body can be directly placed onto the dipole radiator and can in particular be in contact therewith or can be arranged separately therefrom via a narrow gap of preferably no more than 2 mm.

If the dielectric body has an axis of symmetry, it preferably coincides with the axis of symmetry of the dipole radiator. In this respect, an axis that extends in the main radiation direction and with respect to which the dipole segments forming the dipole radiator are symmetrically arranged is understood as the axis of symmetry of the dipole radiator.

The dipole radiator in accordance with the invention is preferably a dual-polarized dipole radiator. The inventors have recognized in this respect that a dielectric body can be used as a waveguide for both polarizations of such a radiator. The two polarizations of the radiator preferably stand orthogonally on one another and/or have separate ports for the supply with cellular radio signals.

The two dipoles of the dual-polarized dipole radiator preferably have the same axis of symmetry, with the two dipoles preferably being arranged in a criss-cross manner with respect to the common axis of symmetry. It can, for example, be a dipole square.

The dipole radiator preferably has a base region that extends in the main radiation direction and has dipole segments that are arranged on the base region and that preferably extend perpendicular to the main radiation direction.

The dipole radiator used in accordance with the invention can comprise one or more additional radiators that are optionally also based on different radiation principles. One or more additional radiators can in particular be integrated in the dipole radiator. For example, the dipole radiator can have one or more slots that act as slot radiators so that from an electrical aspect the dipole radiator used in accordance with the invention is a combination of a dipole radiator and a slot radiator.

In a preferred embodiment of the present invention, the following relationship exists between the maximum thickness D and the height H of the dielectric body, the wavelength λ of the center frequency of the lowest resonant frequency range of the antenna and the relative permittivity $\varepsilon_r$ of the dielectric body:

$$0.5*\left(\frac{\lambda}{\sqrt{\pi(\varepsilon_r-1)}}\right)\leq H$$

and/or $$0.5*\left(\frac{\lambda}{\sqrt{\pi(\varepsilon_r-1)}}\right)\leq D\leq 2.5*\left(\frac{\lambda}{\sqrt{\pi(\varepsilon_r-1)}}\right).$$

The following relationship particularly preferably applies:

$$0.75*\left(\frac{\lambda}{\sqrt{\pi(\varepsilon_r-1)}}\right)\leq H$$

and/or $$0.75*\left(\frac{\lambda}{\sqrt{\pi(\varepsilon_r-1)}}\right)\leq D\leq 2.5*\left(\frac{\lambda}{\sqrt{\pi(\varepsilon_r-1)}}\right)\text{ or}$$

$$\leq 1.25*\left(\frac{\lambda}{\sqrt{\pi(\varepsilon_r-1)}}\right).$$

In this respect, $$D\leq 1.5*\left(\frac{\lambda}{\sqrt{\pi(\varepsilon_r-1)}}\right),$$

preferably $$D\leq 1.25*\left(\frac{\lambda}{\sqrt{\pi(\varepsilon_r-1)}}\right),$$

preferably applies to antennas having a horizontal full width half maximum between 55° and 100°, in particular to antennas having a horizontal full width half maximum of 65°+−10° or 90°+−10.

Alternatively or additionally, the following applies to antennas having a horizontal full width half maximum between 23° and 43° or to antennas having a relative bandwidth of more than 40°:

$$D\leq 2.5*\sqrt{\phantom{x}}.$$

It is taken into account in this respect that a larger multiplier may be required for the diameter in comparison with the wavelength for a very high directivity or bandwidth.

In this respect, a resonant frequency range is understood within the framework of the present invention as a contiguous frequency range of the radiator that has a return loss of better than 6 dB or better than 10 dB or better than 15 dB. The selected limit value of the return loss in this respect depends on the specific use of the antenna. The center frequency is defined as the arithmetical mean of the highest and lowest frequency in the resonant frequency range.

The resonant frequency range and thus the center frequency are preferably determined in accordance with the invention with respect to the impedance position in the Smith chart, while assuming the following elements for an ideal impedance matching and/or impedance transformation.

Within the framework of the use of the antenna in accordance with the invention, the lowest resonant frequency range is preferably understood as the lowest resonant frequency range of the antenna used for transmission and/or reception.

It has been found in this respect that a particularly effective displacement of the radiation plane can be achieved by the above-indicated dimensioning since the dielectric body works particularly well as a waveguide.

The directional effect of the dielectric body can, on the one hand, be influenced by the use of different body shapes and body sizes. A combination with a conductive and/or metallic element is furthermore conceivable to influence the properties of the antenna.

A conductive and/or metallic element is preferably arranged in accordance with the invention in and/or at the dielectric body. The directivity effect can in particular be influenced by such metallic elements.

In a first variant, the conductive and/or metallic element can be a coating of an inner or outer surface of the dielectric body. In a second variant, it can be a conductive and/or metallic disk arranged in or at the dielectric body. Both variants can be combined with one another.

Provision can alternatively or additionally be made that the conductive and/or metallic element surrounds an outer periphery of the dielectric body. It can in this respect in particular be a metalization of the outer periphery of the dielectric body. The conductive and/or metallic element can alternatively extend in a plane perpendicular to the main radiation direction. A metal disk is particularly preferably used in this case that extends in a plane perpendicular to the main radiation direction of the dipole radiator. Such a metallic disk can in this respect, for example be arranged between a rod part and a lens part of the dielectric body.

The conductive and/or metallic element can in particular be used to improve the directivity effect in frequency ranges in which the directivity effect of the dielectric body is less strong.

In accordance with the invention, the conductive and/or metallic element has a directivity effect that is at a maximum for a frequency $f_{met}$. The dielectric body furthermore preferably has a directivity effect that is at a maximum for a frequency $f_{diel}$. In accordance with the invention, the frequencies $f_{met}$ and $f_{diel}$ differ in this respect. The directivity effect of the conductive and/or metallic element and the directivity effect of the dielectric body are hereby at a maximum for different frequency ranges such that the far-field properties of the antenna in accordance with the invention are improved by the combination of dielectric body and conductive and/or metallic element over a larger frequency range.

The frequency $f_{met}$ is in this respect preferably smaller than the frequency $f_{diel}$. The conductive and/or metallic element is thus optimized for smaller frequencies; the dielectric body for larger frequencies.

Alternatively or additionally, the frequency $f_{met}$ can in this respect be smaller than the center frequency $f_{res}$ of the lowest resonant frequency range of the antenna and the frequency $f_{diel}$ can be larger than this center frequency $f_{res}$.

Further alternatively or additionally, there can be a certain spacing between the two frequencies $f_{diel}$ and $f_{met}$. The following relationship preferably applies in this respect:

$$|f_{diel}-f_{met}|/f_{diel}>0.1*f_{diel}, \text{ further preferably } |f_{diel}-f_{met}|/f_{diel}>0.2*f_{diel}.$$

The antenna in accordance with the invention preferably has a reflector on which the dipole radiator is arranged. The reflector preferably has a conductive reflective plane that stands perpendicular on the main radiation direction of the dipole radiator.

In a possible embodiment, the reflector can have a subreflector. This subreflector is preferably configured as a reflector frame. In a particularly preferred embodiment, the edge length of the reflector frame is larger than the maximum thickness D of the dielectric body.

In a further possible embodiment, the spacing between the dipole radiator and the reflector can be between 0.05λ and 0.5λ, preferably between 0.1λ and 0.4λ. λ is in this respect the wavelength of the center frequency of the lowest resonant frequency range of the antenna.

In a further possible embodiment, the reflector can have a directivity effect that is at a maximum for a frequency $f_{ref}$. The dielectric body furthermore preferably has a directivity effect that is at a maximum for a frequency $f_{diel}$, with the two frequencies $f_{ref}$ and $f_{diel}$ not coinciding. The directivity effect is hereby reached over a larger frequency range since the reflector and the dielectric body each bundle ideally for different frequency ranges.

In accordance with a first subvariant, the frequency $f_{ref}$ can be smaller than the frequency $f_{diel}$, i.e. the reflector is adapted for smaller frequencies than the dielectric body.

In a second subvariant, the frequency $f_{ref}$ can be smaller than the center frequency $f_{res}$ of the lowest resonant frequency range of the antenna and the frequency $f_{diel}$ can be larger than the center of the frequency $f_{res}$.

In a third subvariant, there can be a specific spacing between the frequency portions $f_{diel}$ and $f_{ref}$. In this respect, $|f_{diel}-f_{ref}|/f_{diel}>0.1*f_{diel}$ is in particular preferred; further preferably $|f_{diel}-f_{ref}|/f_{diel}>0.2*f_{diel}$.

The above-named embodiments and variants with respect to the reflector can each be implemented per se. The variants are, however, preferably combined with one another.

The antennas in accordance with the invention can in particular be used together with further antennas as a component of an antenna arrangement.

The present invention comprises in a second aspect a cellular radio antenna arrangement having a plurality of antennas, in particular for a cellular radio base station, having a first subgroup of one or more first antennas and a second subgroup of one or more second antennas. In this respect, the first antennas each comprise a dipole radiator having a first dielectric body arranged on the dipole radiator, wherein the height $H_1$ of the first dielectric body amounts to at least 30% of the maximum thickness D of the first dielectric body. The second antennas each comprise a radiator without a dielectric element or with another, second dielectric element. In this respect, in particular a plurality of first antennas are preferably used.

The inventors of the present invention have recognized in this respect that the use of dielectric bodies in cellular radio antenna arrangements having a plurality of antennas allows an influencing of the far-field values of the cellular radio antenna arrangement. In particular since the dielectric bodies can only be used in a first subgroup of radiators or since different dielectric bodies are used for different subgroups of antennas, the effective radiation plane of the respective radiators of the subgroup are changed.

In this respect, a plurality of first antennas are preferably provided, wherein the dipole radiators of the first antennas have identical resonant frequency ranges. The first antennas can in this respect in particular be used for operation in the same cellular radio frequency band. In a preferred embodiment, the dipole radiators of the first antennas are preferably identical.

Provision can alternatively or additionally be made that the dipole radiators of the first antennas have the same radiation plane and/or height $H_{S1}$ above a common reflector. This allows a simple interconnection of the dipole radiators of the first antennas and thus of the first antennas.

Provision can furthermore be made in accordance with the invention that a plurality of second antennas are provided, wherein the radiators of the second antennas have identical resonant frequency ranges. The second antennas can hereby be used for operation in the same cellular radio frequency band. In a preferred embodiment, the radiators of the second antennas are preferably identical.

Alternatively or additionally, the radiators of the second antennas can have the same radiation plane and/or height $H_{S2}$ over a common reflector. A simple interconnection of the radiators of the second antennas and thus of the second antennas is hereby possible.

Provision can furthermore be made that the first dielectric bodies of the first antennas each have the same height $H_1$. The first dielectric bodies are furthermore preferably identical to one another. The first dielectric bodies thus influence the radiation characteristics of the radiators of the first antennas in respectively the same manner.

Provision can furthermore be made that the second dielectric bodies, where they are used, each have the same height Hz. The second dielectric bodies are furthermore preferably identical to one another. The second dielectric bodies hereby also influence the radiation of the radiators of the second antennas in respectively the same manner.

The first dielectric bodies preferably differ from the second dielectric bodies, where they are used, in particular with respect to their height. The first and second dielectric bodies thus influence the radiation of the dipole radiators of the first antennas and the radiators of the second antennas in respectively different manners.

An embodiment is particularly preferred in which only first dielectric bodies are used and the radiators of the second antennas do not have a dielectric element.

In a preferred embodiment of the present invention, the dipole radiators of the first antennas are dual-polarized dipole radiators. The space within the cellular radio antenna arrangement is hereby ideally used.

The radiators of the second antennas can furthermore be dual-polarized radiators. Alternatively or additionally, the radiators of the second antennas can be dipole radiators. The radiators of the second antennas can in particular be dual-polarized dipole radiators. The present invention is, however, likewise used with different radiators of the second antennas.

The first subgroup of antennas of the antenna arrangement in accordance with the invention can have separate ports for transmitting and/or receiving cellular radio signals. The first subgroup of antennas can thus in particular be used separately from the second subgroup of antennas for transmitting and/or receiving cellular radio signals.

Alternatively, the first subgroup and the second subgroup of antennas of the antenna arrangement in accordance with the invention can, however, also have common ports for transmitting and/or receiving cellular radio signals.

Provision can be made in accordance with the invention that the antennas of the first subgroup and/or the antennas of the second subgroup each form one or more group antennas and have common ports for transmitting and/or receiving cellular radio signals.

The first antennas of the first subgroup can in this respect in particular be interconnected to form one or more group antennas. The first antennas of the first subgroup can in particular in this respect be connected to one or more common ports via one or more phase shifters.

In the same manner, the second antennas of the second subgroup can form one or more group antennas and can in particular be connected to one or more common ports via one or more phase shifters.

In an alternative embodiment, the antennas of the first subgroup can each have separate ports for transmitting and/or receiving cellular radio signals. Alternatively or additionally, the antennas of the second subgroup can also each have separate ports for transmitting and/or receiving cellular radio signals. Beam-forming or beam-shaping applications are possible due to the separate ports of the individual antennas. The individual antennas can in particular in this respect preferably be interconnected to form different group antennas and/or can each be operated individually for separate channels.

The use in accordance with the invention of dielectric bodies has advantages with many different antenna arrangements. Depending on the embodiment of the antenna arrangement, the dielectric bodies can in this respect be used to displace the radiation planes of the respective subgroups of antennas away from one another or to move them toward one another or to increase the radiation plane of lower arranged antennas to improve their radiation characteristics.

In a first variant of the cellular radio antenna arrangement in accordance with the invention, the dielectric bodies shift the radiation planes of the first antennas and of the second antennas away from one another. In this respect, the first dielectric bodies can in particular be used to move the radiation plane of the first antennas away from the radiation planes of the second antennas. The coupling of the first antennas and of the second antennas in the cellular radio antenna arrangement is hereby reduced.

Such a shift of the radiation planes is in this respect in particular used when the dipole radiators of the first antennas and the radiators of the second antennas are arranged in a common plane and/or have the same height $H_S$ above a common reflector. In this case, the radiators of the first and second antennas would per se have the same radiation planes. It is, however, achieved by the use of dielectric bodies that the first antennas have a different radiation plane than the second antennas. In this respect, the radiation plane of the first antennas is in particular raised above the radiation plane of the second antennas.

In this respect, the shift V of the radiation plane by the first dielectric body and the height $H_S$ of the dipole radiators of the first antennas above a common reflector preferably have the following relationship: $0.5\ H_S > V$. Alternatively or additionally, the height $H_1$ of the first dielectric bodies and the height $H_S$ of the dipole radiators of the first antennas above a common reflector have the following relationship: $0.5\ H_S > H_1$.

The shift in accordance with the invention of the radiation planes can in this respect in particular be used in a cellular radio antenna arrangement in which the dipole radiators of the first antennas and the radiators of the second antennas have the same resonant frequency ranges and/or have the same structure. Depending on the specific application purpose, the first and second antennas can in this respect be used for the same or for different cellular radio bands. Even if the dipole radiators of the first antennas and the radiators of the second antennas in this respect have the same resonant frequency ranges and/or have the same structure, the resonant frequency ranges of the individual antennas formed by the radiators and the dielectric bodies can nevertheless differ since the use of the dielectric bodies also has an influence on the resonant frequency ranges of the antenna formed by radiators and dielectric bodies.

A shift in accordance with the invention of the radiation planes can in this respect be used both when the antennas of the first and second subgroups each form one or more group antennas and when the antennas of the first and second subgroups each have separate ports for transmitting and receiving cellular radio signals. In a further possible embodiment, the first and second antennas can be interconnected together to form one or more group antennas.

In a further embodiment variant of the present invention, the dielectric bodies move the radiation planes of the first antennas and of the second antennas toward one another. The first dielectric bodies can thus be used to move the radiation plane of the first antennas toward the radiation plane of the second antennas.

Such a movement of the radiation planes toward one another is in this respect in particular used when the dipole radiators of the first antennas and the radiators of the second antennas are arranged in different planes and/or have different heights $H_{S1}$ and $H_{S2}$ above a common reflector. With such an arrangement, the dipole radiators of the first antennas and the radiators of the second antennas in principle have different radiation planes. This spacing between the radiation planes of the radiators can be reduced by the use of the dielectric bodies.

In a preferred embodiment, the nevertheless remaining spacing A between the radiation planes has the following relationship to the height $H_{S1}$ of the first dipole radiators above a common reflector: $A > 0.5\ H_{S1}$, preferably $A > 0.2\ H_{S1}$. In this respect, the spacing A can also completely become 0, i.e. the radiation planes are equalized with respect to one another.

Such a movement toward one another of the radiation planes is preferably used when the dipole radiators of the first antennas and the radiators of the second antennas have the same resonant frequency ranges and/or have the same structure. Such an embodiment is furthermore preferably used when the dipole radiators of the first antennas and the radiators of the second antennas are interconnected together to form one or more group antennas. The radiation plane of the individual radiators of a group antenna formed by dipole radiators of the first antennas and radiators of the second antennas can in particular hereby be approximated to one another.

In a third variant of the present invention that can be combined with the first and/or second variant, the dipole radiators of the first antennas are arranged in a first plane and the second antennas have metal structures that are arranged in a second plane above the first plane. Provision is made in this respect that the first dielectric bodies extend at least up to the second plane of the metal structures of the second antennas and/or raise the radiation plane of the dipole radiators of the first antennas to at least the second plane. It is thus prevented by the use of the dielectric bodies that the metal structures of the second antennas impair the radiation characteristics of the dipole radiators of the first antennas in a manner such as was frequently to be found in the prior art.

Such an embodiment is in particular used when the height $H_{S1}$ of the dipole radiators of the first antennas above a common reflector is smaller than the height $H_{S2}$ of the radiators of the second antennas above the common reflector.

Such an embodiment can furthermore in particular be used when the center frequency of the lowest resonant frequency range of the dipole radiators of the first antennas is higher than the center frequency of the lowest resonant frequency range of the radiators of the second antennas or when the first antennas are used for radiating in a higher frequency band than the second antennas. In this case, the radiators of the second antennas are typically larger than the dipole radiators of the first antennas and therefore project over the dipole radiators of the first antennas. Due to the shift in accordance with the invention of the radiation plane of the dipole radiators of the first antennas due to the use of the first dielectric bodies, their radiation power can be substantially improved since they are less pronouncedly influenced by the radiators of the second antennas.

In a possible embodiment, the radiators of the second antennas can be configured as dipole radiators and can be arranged in a plane above the plane of the dipole radiators of the first antennas. The radiators of the second antennas can in particular have bases in this respect that are higher than the bases of the dipole radiators of the first antennas such that the dipole segments of the radiators of the second antennas arranged on the bases are arranged above the dipole segments of the radiators of the first antennas. In this case, the first dielectric bodies are designed such that they project at least up to the dipole segments of the dipole radiators of the second antennas and preferably beyond them. In this case, the first and second antennas are preferably used for different frequency bands and/or have different resonant frequency ranges.

The second antennas can in this respect comprise a plurality of dipoles that are arranged in the shape of a square and/or of a cross and/or of a T.

In a further embodiment that can be combined with the above-described embodiment, third radiators can be arranged in the region of the radiators of the second antennas. These third radiators preferably have the same resonant frequency range and/or are used for the same frequency band as the dipole radiators of the first antennas. Alternatively or additionally, the dipole radiators of the first antennas and the radiators of the second antennas can have different resonant frequency ranges and/or can be used for different frequency bands.

By the arrangement of the third radiators in the region of the radiators of the second antennas, said radiators can typically not have the same plane as the dipole radiators of the first antennas. The third radiators can in this respect in particular be arranged on radiators of the second antennas and can thus be arranged on a different plane than the dipole radiators of the first antennas. Further alternatively or additionally, the dipole radiators of the first antennas are arranged between the radiators of the second antennas.

In such an embodiment, the first dielectric bodies have a dual function. On the one hand, they improve the radiation possibilities of the first antennas since the radiators of the second antennas impede the radiation of the dipole radiators of the first antennas less due to the shift of their radiation plane. Furthermore, the radiation plane of the dipole radiators of the first antennas is approximated to the radiation plane of the third radiators by the first dielectric bodies.

In a possible embodiment, the radiators of the second antennas can have radiator elements that extend in parallel with and/or perpendicular to and/or obliquely to the radiation direction. In this respect, the third radiators can be arranged within the radiator elements extending in parallel with and/or perpendicular to and/or obliquely to the radiation direction. Alternatively or additionally, the third radiators can be dual-polarized radiators.

The dipole radiators of the first antennas and the third radiators can have the same structure.

The last-described embodiment of a cellular radio antenna arrangement can in particular be used when the dipole radiators of the first antennas and the third radiators of the first antennas are interconnected and/or interconnectable to form a group antenna. The dipole radiators of the first antennas and the third radiators can in this respect in particular be combined via one or more phase shifters to form one or more group antennas.

The cellular radio antenna arrangement in accordance with the invention preferably comprises at least one column or row of antennas, wherein the first and second antennas are arranged alternately in the column or row and/or wherein the second antennas are arranged between two columns or rows of first antennas. The group antenna can in this respect in particular have a plurality of columns and rows, with the first and second antennas each being alternately arranged in the plurality of columns and rows, and/or with the second antennas being arranged between a plurality of columns and rows of first antennas.

The cellular radio antenna arrangement can furthermore have a housing within which the first and second antennas are arranged. The cellular radio antenna arrangement furthermore preferably has ports via which the cellular radio antenna arrangement is connectable to a cellular radio base station. Phase shifters can furthermore be provided in the housing via which antennas of the cellular radio antenna arrangement are interconnected to form group antennas.

In a cellular radio antenna arrangement in accordance with the second aspect of the present invention, cellular radio antennas such as have been described in more detail in accordance with the first aspect of the present invention are preferably used as first antennas.

This in particular relates to the configuration and/or dimensioning of the first dielectric bodies of the first antennas that is/are preferably carried out as shown above with respect to the first aspect.

The second antennas can in this respect admittedly in principle likewise be designed in accordance with the first aspect of the present invention. The second antennas, however, preferably do not have any dielectric bodies and are accordingly not configured in accordance with the first aspect of the present invention.

The present invention will now be shown in more detail with reference to embodiments and to drawings. There are shown:

DETAILED DESCRIPTION

Figure 1:
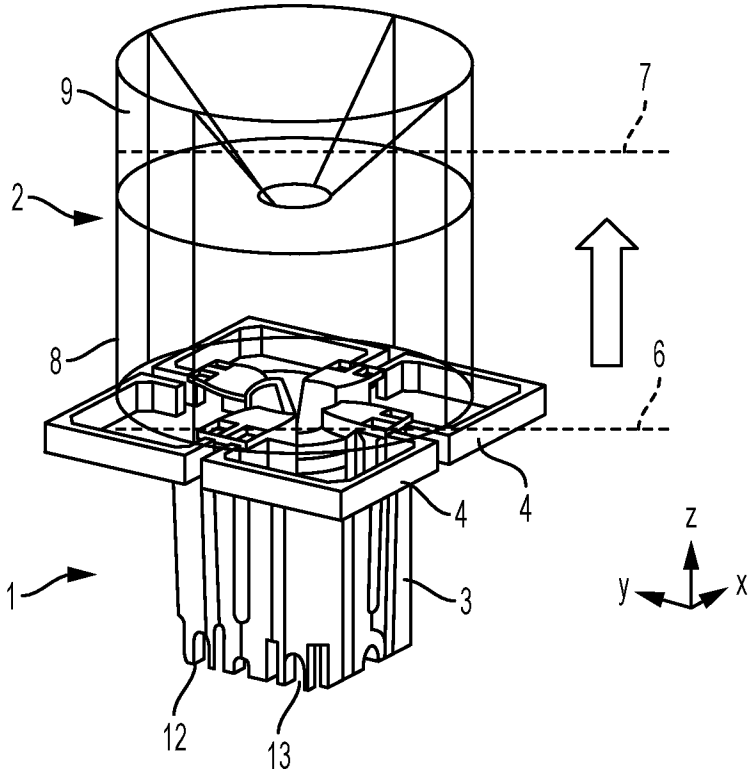
FIG. 1: a first embodiment of a cellular radio antenna in accordance with the invention.
Figure 2:
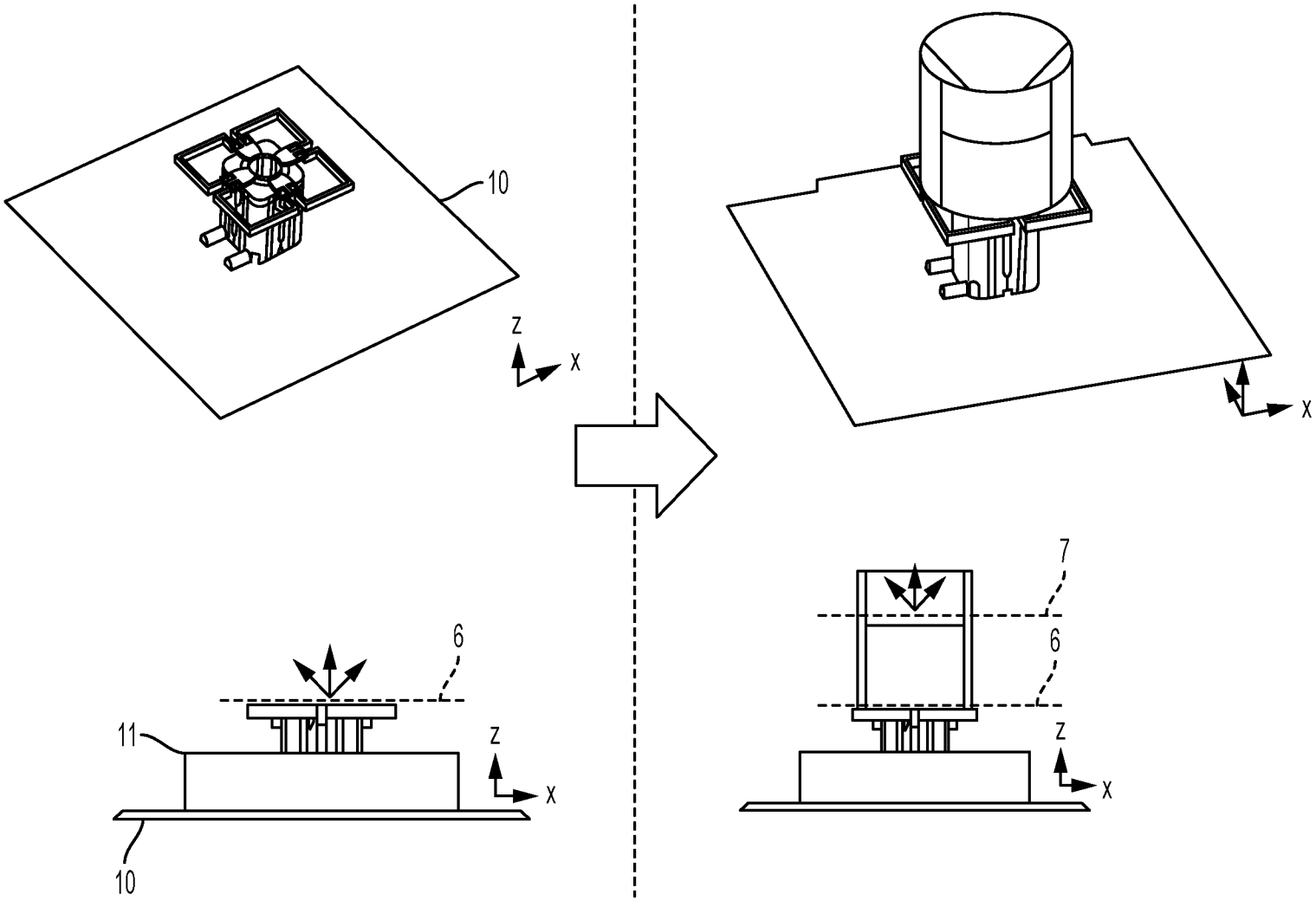
FIG. 2: a comparative representation between a cellular radio antenna in accordance with the prior art and the first embodiment in FIG. 1.
Figure 3:
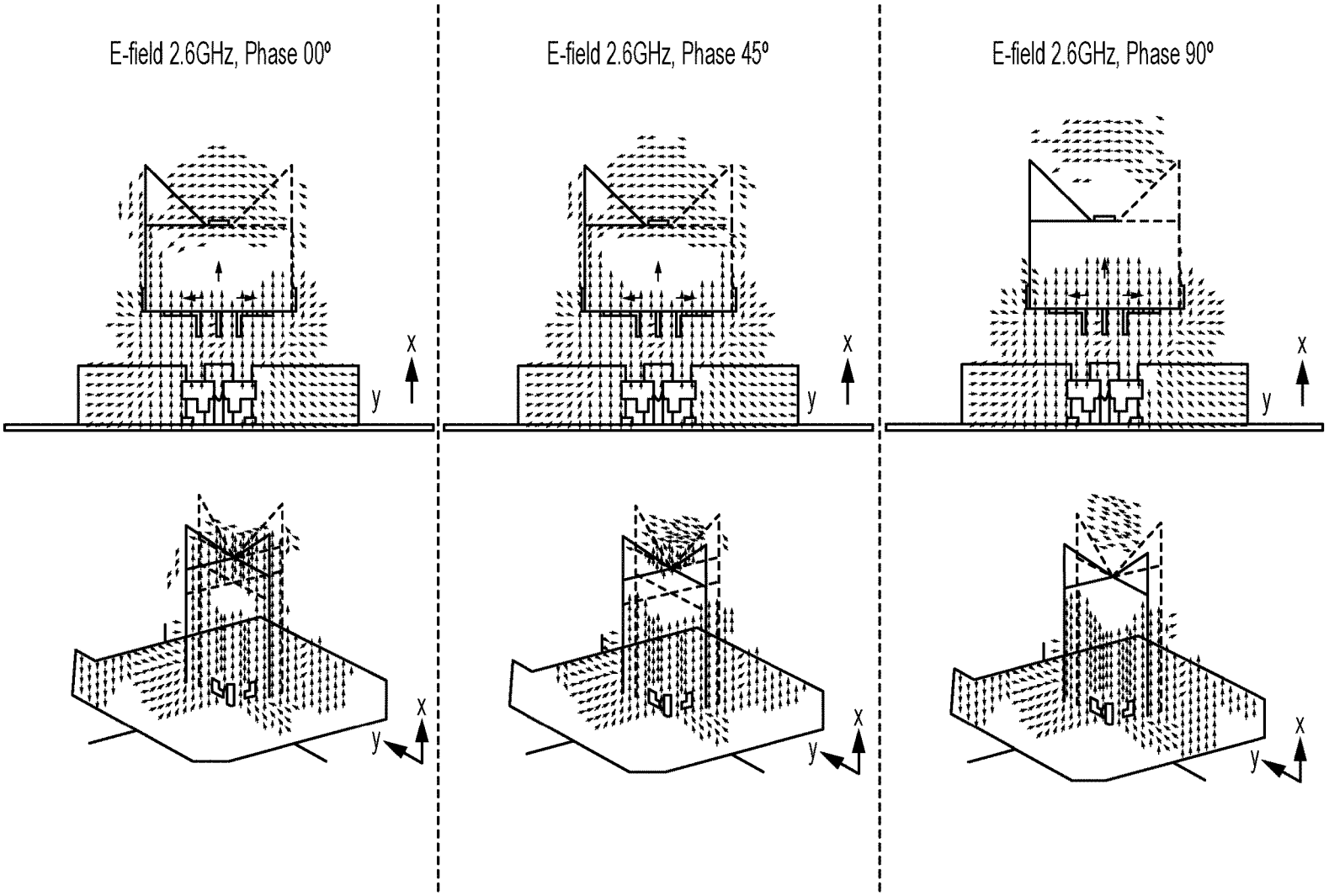
FIG. 3: the E-field distribution at a transmission frequency of 2.6 GHz in the embodiment shown in FIG. 1.

FIGS. 1 to 3 show a first embodiment of a cellular radio antenna in accordance with the invention. It is in this respect preferably a cellular radio antenna that is connected via signal lines to a cellular radio base station to receive and/or to transmit cellular radio signals.

The embodiment of the cellular radio antenna comprises a dipole radiator 1 on which a dielectric body 2 is arranged. The dipole radiator 1 has a base 3 which supports dipole segments 4. The dipole segments 4 extend in a plane perpendicular to the main radiation direction of the cellular radio antenna. The base 3 in contrast extends in the main radiation direction.

The dipole radiator 1 is arranged on a reflector 10 that is of plate shape and extends in a plane perpendicular to the main radiation direction and thus in parallel with the plane of the dipole segments 4. The dipole segments 4 are held at a height $H_S$ above the reflector 10 by the base 3.

In the embodiment, the dipole radiator 1 is a dual-polarized dipole radiator. The first polarization is formed by a first dipole formed by two oppositely disposed dipole segments 4; the second polarization by two further dipole segments 4 likewise oppositely disposed. The two polarizations stand orthogonally and criss-cross on one another. In the embodiment, the dipole radiator is designed as a dipole square in which the four dipole segments are arranged about a common axis and adopt four sectors of a square.

The two polarizations of the dipole radiator are used separately from one another in the embodiment for transmitting and/or receiving cellular radio signals and have separate ports 12 and 13 for this purpose.

In accordance with the invention, a dielectric body 2 is arranged on the dipole radiator 1. The dielectric body 2 has a lower side with which it is arranged on the plane formed by the dipole segments 4 of the dipole radiator 1. The lower side of the dielectric body can comprise mechanical fastening regions for fastening to the dipole. They can e.g. project as noses and/or grooves into the region of the dipole. The lower side of the dielectric body is preferably planar, at least with the exception of the mechanical fastening regions, and/or extends in parallel with the plane of the dipole segments 4 or with a plane standing perpendicular on the main radiation direction of the antenna.

The lower side of the dielectric body is preferably placed directly onto the dipole segments 4 or is only separated therefrom by a narrow air gap of preferably a maximum of 2 mm and both preferably of a maximum of 1 mm.

In the embodiment shown in FIG. 1, the dielectric body comprises a rod region 8 and a lens region 9. In the rod region 8, the dielectric body has a cross-section remaining constant in the main radiation direction, with it being the cross-section in a plane perpendicular to the main radiation direction. In the lens region 9 that is arranged at the side of the rod region 8 remote from the dipole radiator in the radiation direction, the dielectric body in contrast has a cross-section varying in the main radiation direction.

In the embodiment, the dielectric body has rotationally symmetry. The axis of symmetry of the dielectric body extends in parallel with the main radiation direction of the dipole radiator 1 and coincides with the axis of symmetry of the dipole radiator 1.

In the rod region 8, the dielectric body is designed as a solid circular cylinder. The lens region 9 is designed as a counter-cone in the embodiment. However, other shapes are also conceivable for the lens region as will be shown in more detail in the following. The lens region 9 can furthermore also be completely dispensed with so that the total dielectric body is configured as a dielectric rod.

The dielectric body in accordance with the present invention is used to displace the radiation plane 6 of the dipole radiator in the main radiation direction so that the radiation plane 7 of the antenna formed from the dipole radiator 1 and the dielectric body 2 is arranged above the radiation plane 6 of the dipole radiator 1 itself. This shift of the radiation plane makes possible, as will be shown in even more detail in the following, a plurality of applications, in particular when the cellular radio antenna in accordance with the invention is combined with further antennas in an antenna arrangement.

In the embodiment, the antenna furthermore has a subreflector frame 11 that is arranged on the plate-like main reflector 10 and that surrounds the antenna. The subreflector frame effects an improvement of the directional effect.

The shift in accordance with the invention of the radiation plane is demonstrated by the E-field diagrams shown in FIG. 3. As can be recognized from these diagrams, the region of the greatest E-field distribution and thus the radiation plane is shifted in the radiation direction from the plane of the dipole segments of the dipole radiator 1, and indeed by at least the height of the rod region 8 of the dielectric body 2, by the dielectric body placed onto the antenna.

Figure 4:
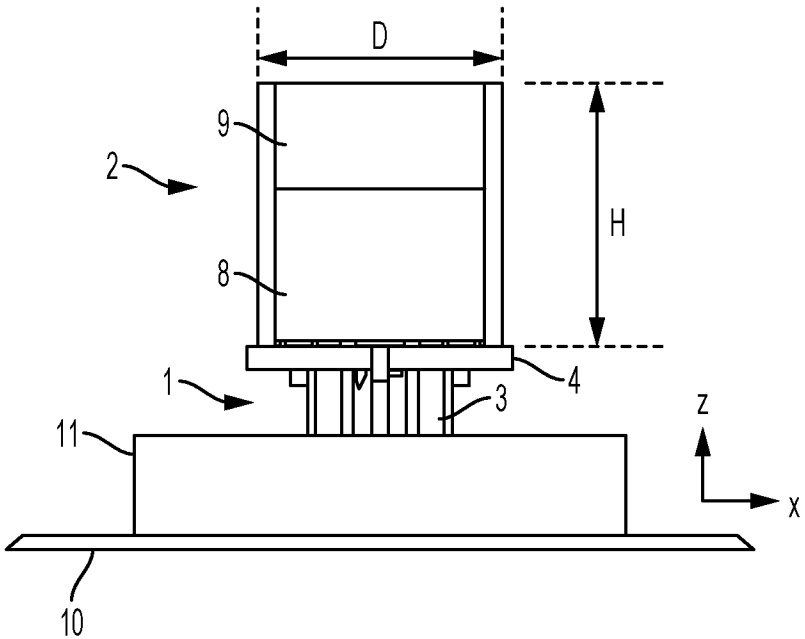
FIG. 4: the embodiment of the present invention shown in FIG. 1, with the maximum thickness D and the height H of the dielectric body being shown.

In FIG. 4, the dimensions of the dielectric body are again drawn schematically. The maximum thickness D of the dielectric body 2, i.e. its maximum extent in a plane perpendicular to the main radiation direction, and the height H of the dielectric body, i.e. a maximum extend in the radiation direction, are in particular drawn in.

In accordance with the present invention, dielectric bodies are used in which the height H amounts to at least 30% of the maximum thickness D. The height H preferably amounts to at least 50% of the maximum thickness D, further preferably at least 70% of the maximum thickness D. A corresponding shift of the radiation plane is hereby achieved in accordance with the invention.

Alternatively or additionally, the height of the rod region 8, i.e. the maximum extent of the rod region in the main radiation direction, amounts to at least 20% of the maximum thickness D. preferably at least 30% of the maximum thickness D, further preferably at least 40% of the maximum thickness D.

Figure 5:
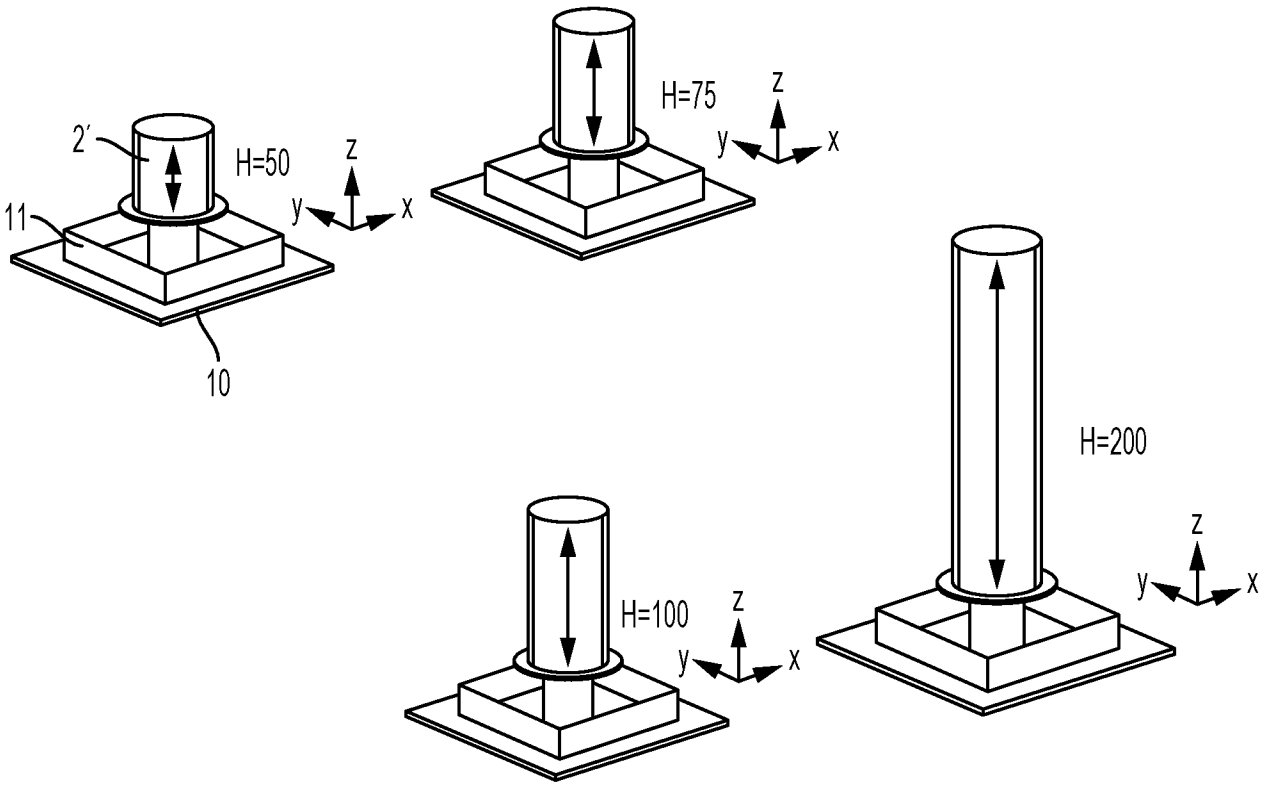
FIG. 5: four embodiments of cellular radio antennas in accordance with the invention with dielectric bodies of different heights.

The height H of the dielectric body or of the rod region of the dielectric body is at least not limited in principle. FIG. 5 in this respect shows four different embodiments that differ with respect to the height H of the dielectric body. In all embodiments, the dielectric body has a diameter D of 50 mm. The height H in the four embodiments amounts to 50 mm, 75 mm, 100 mm and 200 mm. In the four embodiments, a dielectric body was used that only comprises a rod region and does not have a lens region.

Figure 6:
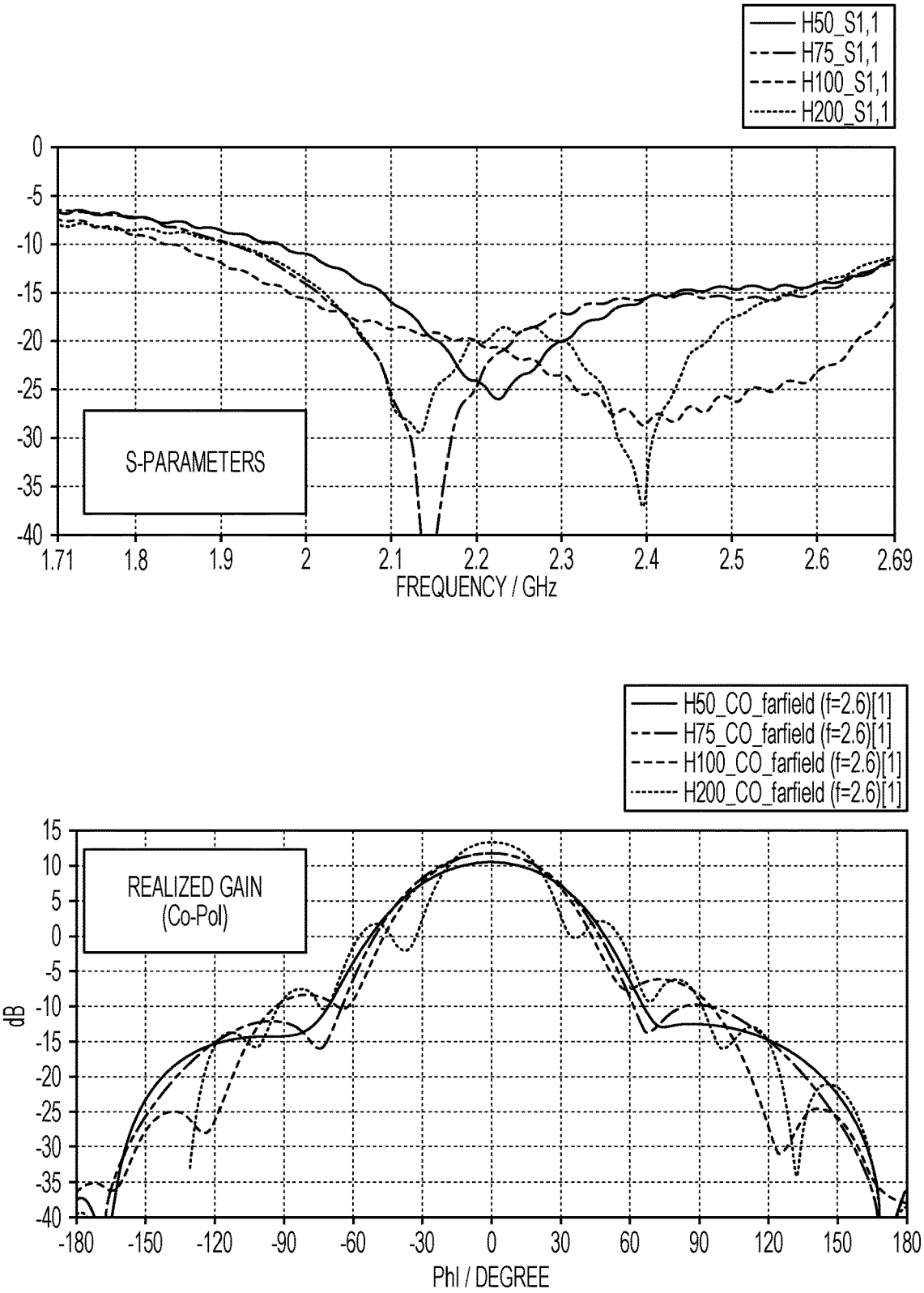
FIG. 6: two diagrams that show the S-parameter in dependence on the frequency and on the antenna gain in dependent on the radiation angle for the four embodiments shown in FIG. 5.

FIG. 6 shows in the upper diagram the S-parameter in co-polarization in dependence on the frequency in a frequency range between 1.7 GHz and 2.7 GHz. It becomes clear in this respect that the extent of the S-parameter depends on the height H. The height H furthermore also has an influence on the position of the resonant frequency range, with larger heights tending to widen the resonant frequency range.

The diagram at the bottom of FIG. 6 shows the far-field diagram for the different heights of the dielectric body. The longer the dielectric body becomes, the higher the directional effect becomes in the main radiation direction, i.e. at phi=0 degrees, and the more local minima and maxima arise in the far-field diagram.

The increasing number of local minima/maxima is due to constructive and/or destructive superposition of electromagnetic fields. It can be assumed in this respect that the local minima and maxima arise due to different radiation points along the axis of the dielectric body, i.e. a proportion of the energy is radiated along the body (radiating modes) and a proportion of the energy is conducted onward (bound modes).

Figure 7:
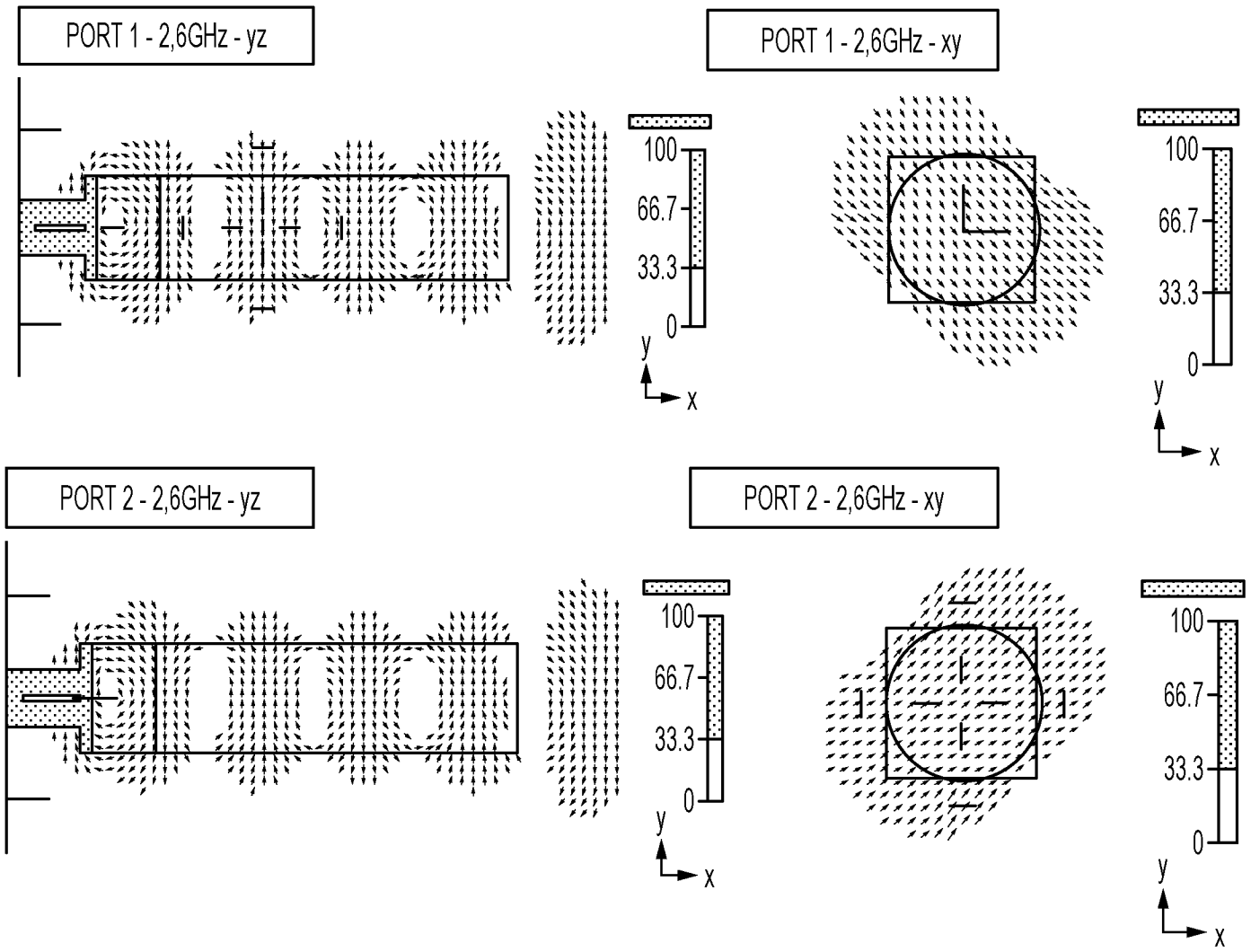
FIG. 7: four diagrams that show the E-field distribution for the last of the embodiments shown in FIG. 5 with a height H of the dielectric body of 200 mm, and indeed separately for the first and second ports at a transmission frequency of 2.6 GHz.

FIG. 7 shows the electrical field in V/m for the frequency 2.6 GHz and for a dielectric body having a height H of 50 mm and 200 mm. At both body heights, the electrical field completely passes through the dielectric bodies. The electric field is furthermore periodically repeated in the body having a height H of 200 mm along the Z axis, i.e. in the main radiation direction. This illustrates the waveguide function and the shift of the phase center of the radiation along the z axis and thus in the main radiation direction.

FIG. 7 shows the electrical field for the antenna port 1 and thus polarization 1, as well as for the antenna port 2 and thus in the polarization 2. Both fields are orthogonal to one another, whereby a high insulation or decoupling is achieved between the two antenna ports.

FIG. 7 on the one hand shows that the height H of the dielectric body may not fall below a specific minimum height if the dielectric body is intended to operate as a waveguide.

This simultaneously also explains the secondary lobes arising with an increasing length. They can be explained by the incomplete conduction of the field through the dielectric body and the partial radiation at the respective field maxima.

Figure 8:
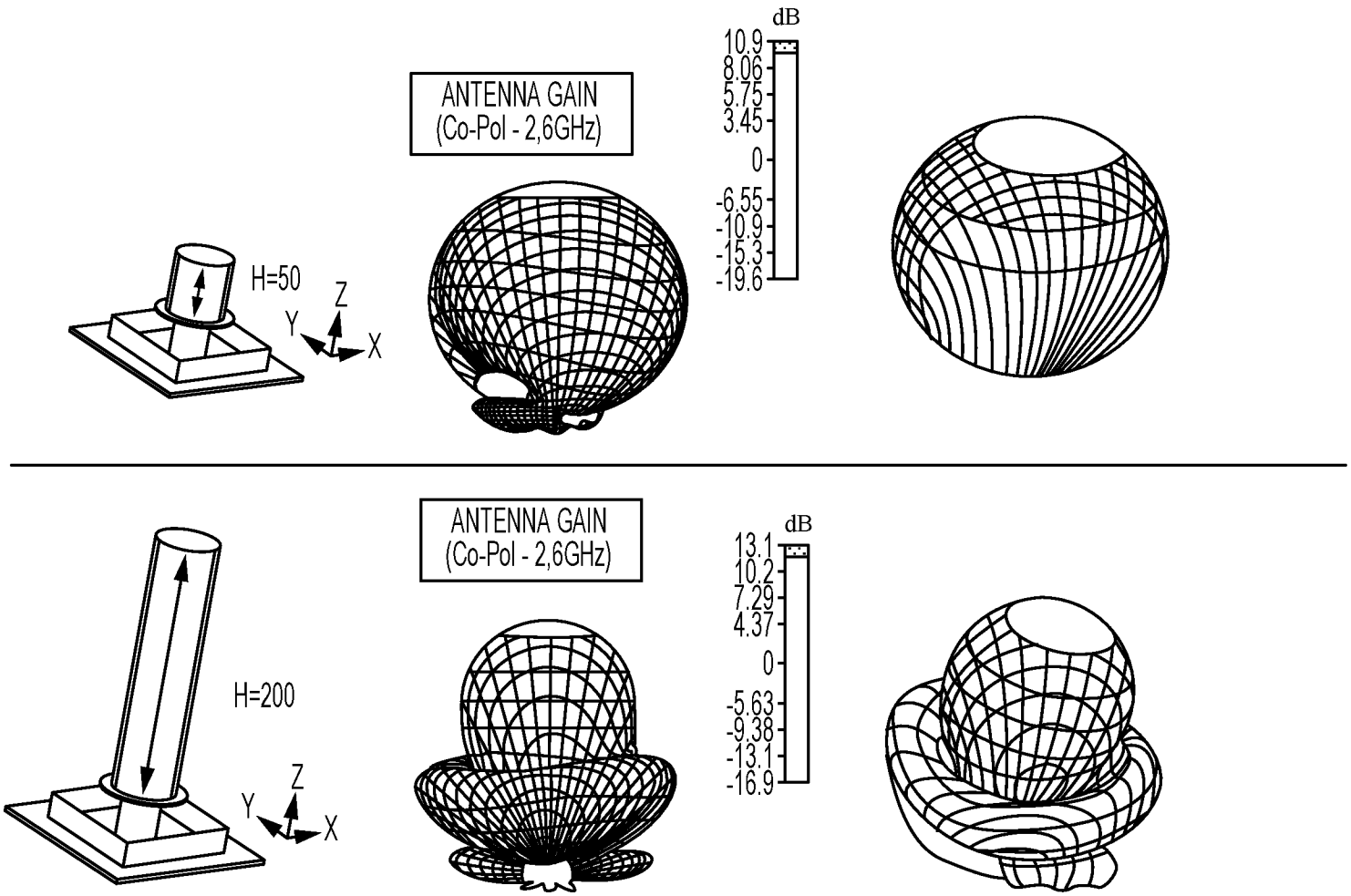
FIG. 8: the first and last embodiments of the four embodiments shown in FIG. 5 with two representations of the antenna gain at a transmission frequency of 2.6 GHz.

The antenna gain in copolarization at 2.6 GHz for a height of 50 mm and a height of 200 mm of the dielectric body is again shown three-dimensionally in FIG. 8. As can be clearly recognized, the directivity of the main lobe is clearly enlarged by the extension of the dielectric body; however, secondary lobes arise.

Figure 9:
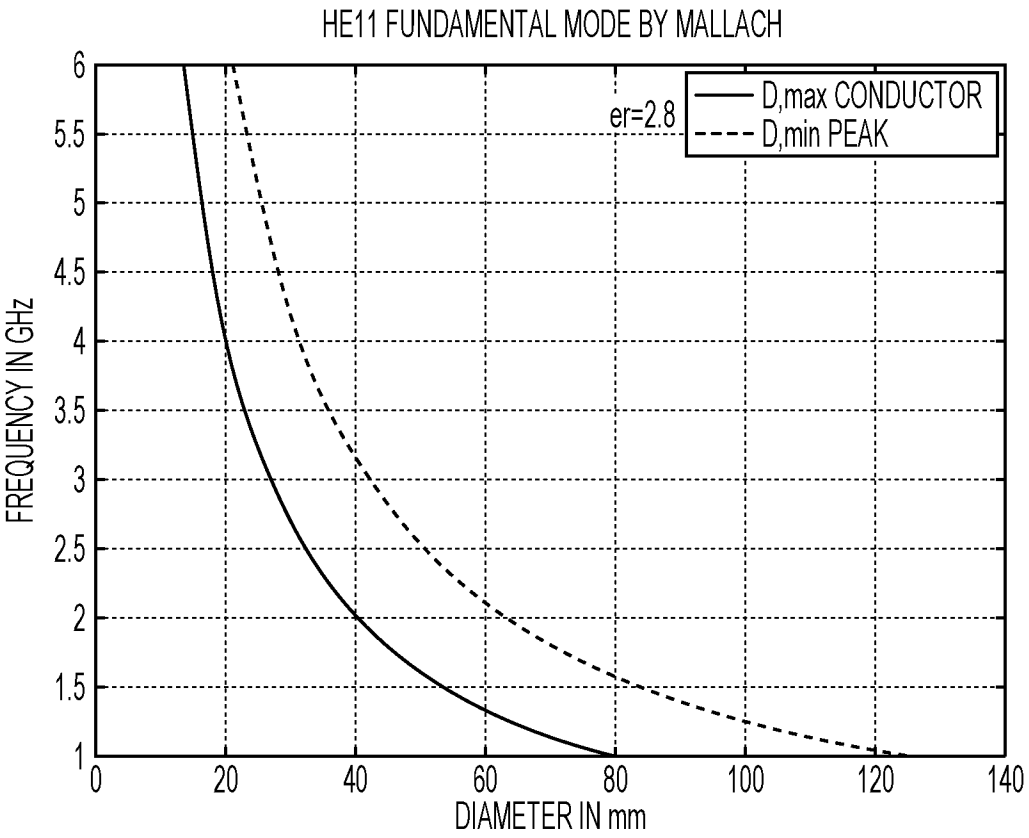
FIG. 9: a formula and a diagram showing the dependency of the maximum thickness of a rod region and of a lens region on the wavelength of the center frequency and the relative permittivity.

The claimed relationship in accordance with the invention between the height H of the dielectric body and the thickness D of the dielectric body results when the dielectric body is considered to be a rod antenna. FIG. 9 in this respect shows the dependency of the thickness of such a rod antenna on the wavelength of the center frequency of the resonant frequency range and the effective relative permittivity $\varepsilon_r$ with a rod radiator.

The formulas for the diameter $d_{max,Leiter}$ of the rod region and thus the maximum thickness of the dielectric body and the diameter $d_{min,Spitze}$ at the thinnest point of the lens region are reproduced at the left-hand side. This dependency is shown again graphically in a diagram at the right. The maximum thickness of the dielectric body can therefore not be selected as desired, but has to be selected in dependence on the wavelength and on the relative permittivity.

For the purposes of the present invention, the maximum thickness D of the dielectric body, in particular the maximum thickness of the rod region, is in this respect selected in the following range:

$$0.5*\left(\frac{\lambda}{\sqrt{\pi(\varepsilon_r-1)}}\right)\leq D\leq 1.5*\left(\frac{\lambda}{\sqrt{\pi(\varepsilon_r-1)}}\right),$$

preferably $$0.75*\left(\frac{\lambda}{\sqrt{\pi(\varepsilon_r-1)}}\right)\leq D\leq 1.25*\left(\frac{\lambda}{\sqrt{\pi(\varepsilon_r-1)}}\right).$$

A comparable dependency on the wavelength and on the relative permittivity applies at least as a lower limit to the height H:

$$0.5*\left(\frac{\lambda}{\sqrt{\pi(\varepsilon_r-1)}}\right)\leq H$$

preferably $$0.75*\left(\frac{\lambda}{\sqrt{\pi(\varepsilon_r-1)}}\right)\leq H$$

The claimed relationship between the height H of the dielectric body and the maximum thickness D hereby also results.

The influence of the maximum thickness D of the dielectric body on the wave guidance properties and thus the radiation characteristics of the antenna produced by the dipole and the dielectric body will now be shown again with reference to FIGS. 10 and 11. In this respect, on the one hand, a comparison example without a dielectric body (000) as well as two examples 001 and 002, each have dielectric bodies of different sizes, are shown at the top in FIG. 10.

In the embodiment, the reflector respectively has a length and a width of 144 mm, the subreflector has a length and a width of 97 mm and a height of 21 mm. The dipole radiator used is in all embodiments the identical radiator having a resonant frequency range between 1.7 and 2.7 GHz.

In the example 001, the dielectric body has a diameter, and thus a maximum thickness D in the sense of the present invention, of 90 mm and a height H of 80 mm; in the example 002, a diameter, and thus a maximum thickness D in the sense of the present invention, of 50 mm and a height H of 50 mm. The relative permittivity of the material used amounts to 2.8 in each case.

Figure 10:
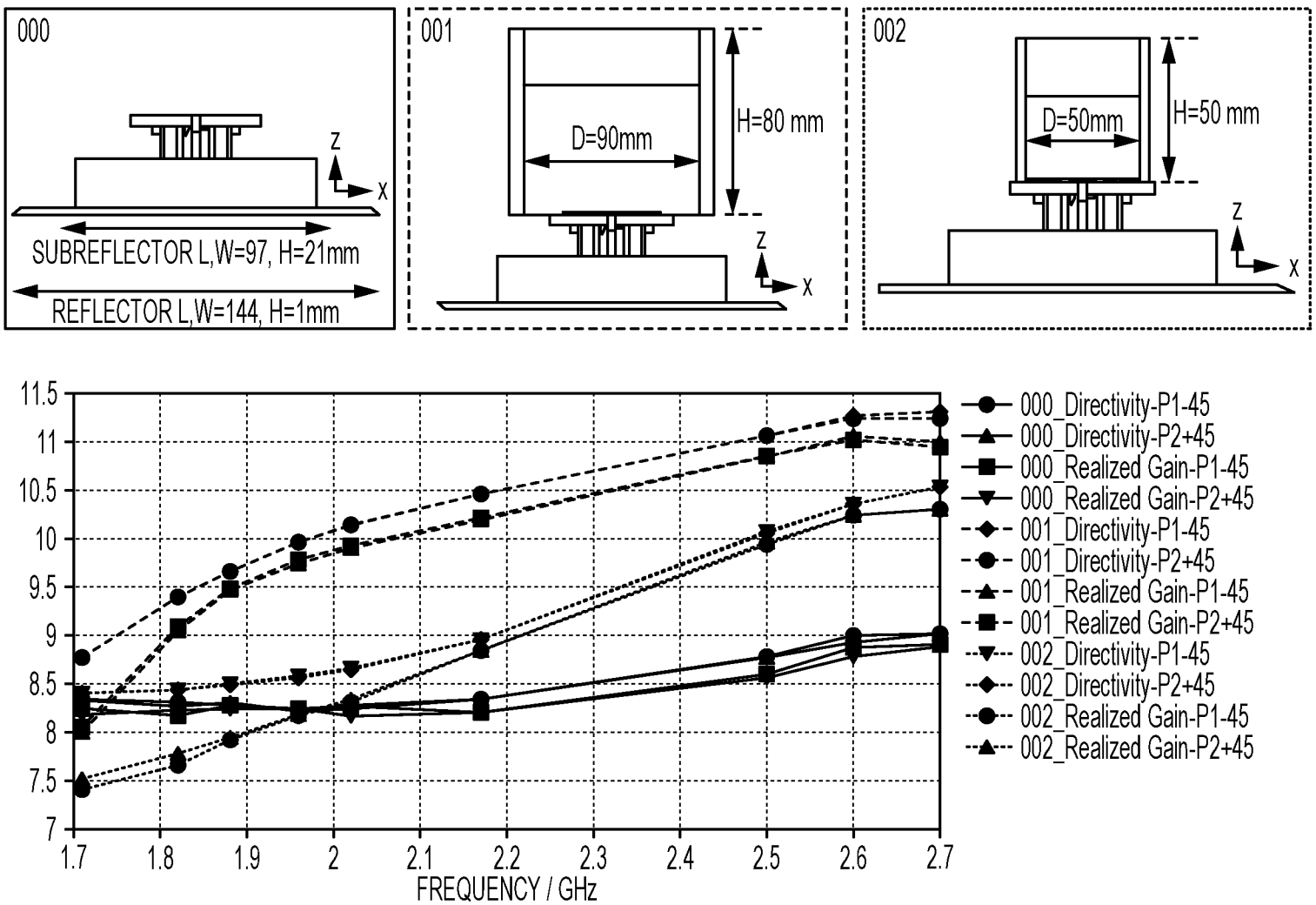
FIG. 10: a cellular radio antenna in accordance with the prior art and two embodiments of cellular radio antennas in accordance with the present invention as well as a diagram that shows the directivity and the gain for the individual ports.

In the diagram at the bottom of FIG. 10, the gain and the directivity are shown for the three antennas in dependence on the frequency. The diagram shows an improvement of the directional effect and of the gain on the use of a dielectric body. The effect is substantially more pronounced for the example 002, i.e. for the dielectric body having the smaller diameter D, for higher frequencies than for lower frequencies.

The use of the dielectric body having the smaller diameter D furthermore also has the result that the resonant frequency range is changed. While the total frequency range between 1.8 and 2.7 can be used for the larger dielectric body, the smaller dielectric body in example 002 restricts the usable range to frequencies between 2.1 and 2.7. The smaller dielectric body therefore evidently no longer works as a waveguide for lower frequencies due to its small diameter. However, no diagram is included for this.

Figure 11:
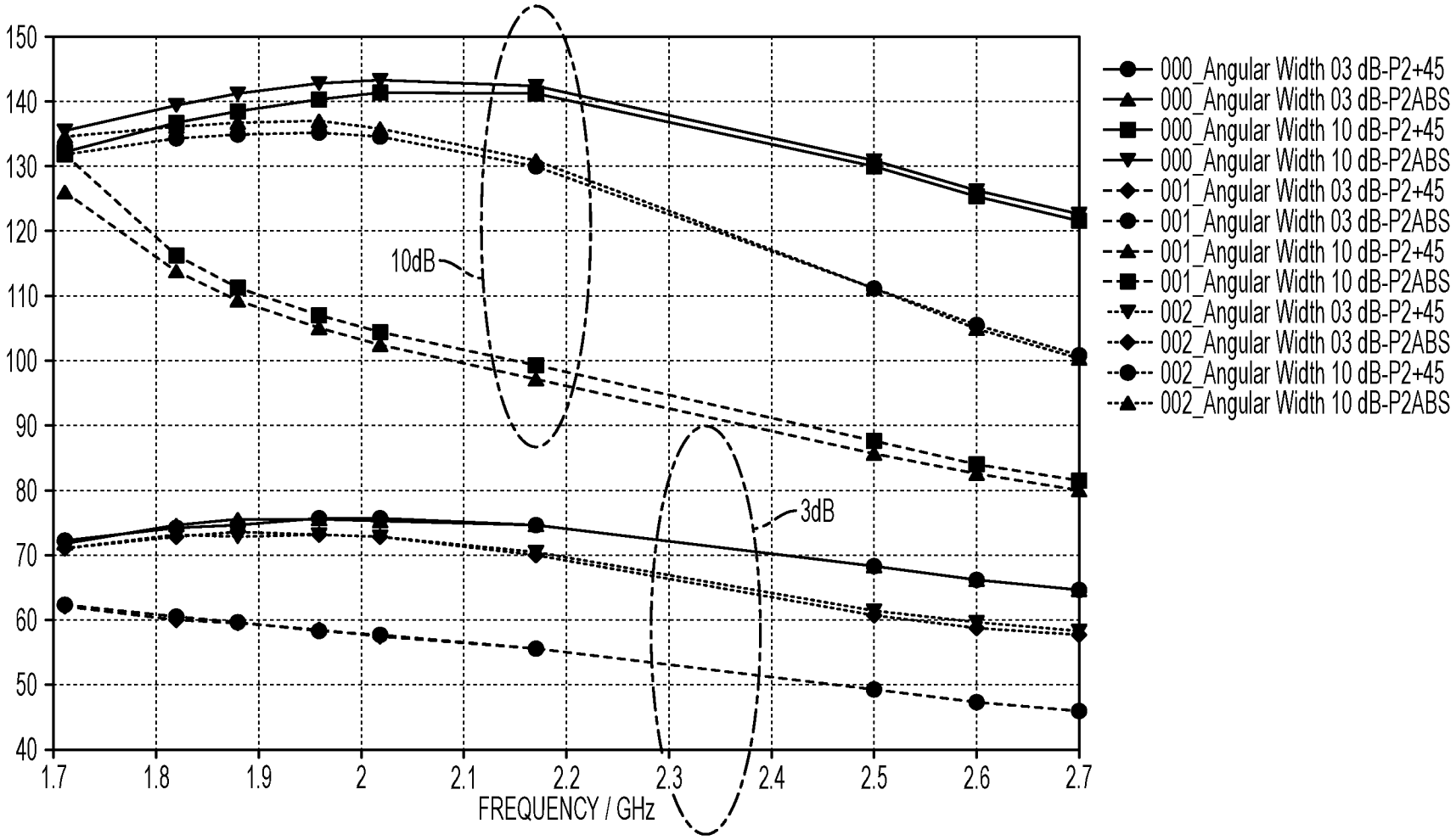
FIG. 11: a diagram reproducing the width of the antenna diagram for the cellular radio antennas shown in FIG. 10.

The diagram in FIG. 11 now shows the opening angle at 10 dB or 3 dB for the three examples. The smaller opening angle on the use of the dielectric bodies in accordance with the invention is in turn also shown here.

The dielectric body preferably has an effective relative permittivity of more than 2, further preferably of more than 2.5.

This can be achieved, for example, by the production of the dielectric body from a solid material having a corresponding relative permittivity. Instead, the body could also be produced from a material having a higher relative permittivity of e.g. 6 and could have air holes that again reduce the effective relative permittivity of the dielectric body. Instead, a material having a low relative permittivity could also be used into which a granulate having a high relative permittivity is injected. For example in this respect, a granulate having a relative permittivity of 30 could be introduced into a matrix material having a relative permittivity of 1.

The effective relative permittivity is in this respect constant over the extent of the dielectric body in a preferred embodiment.

However, a material having a gradient of the relative permittivity could also be used to influence the radiation properties.

Figure 12:
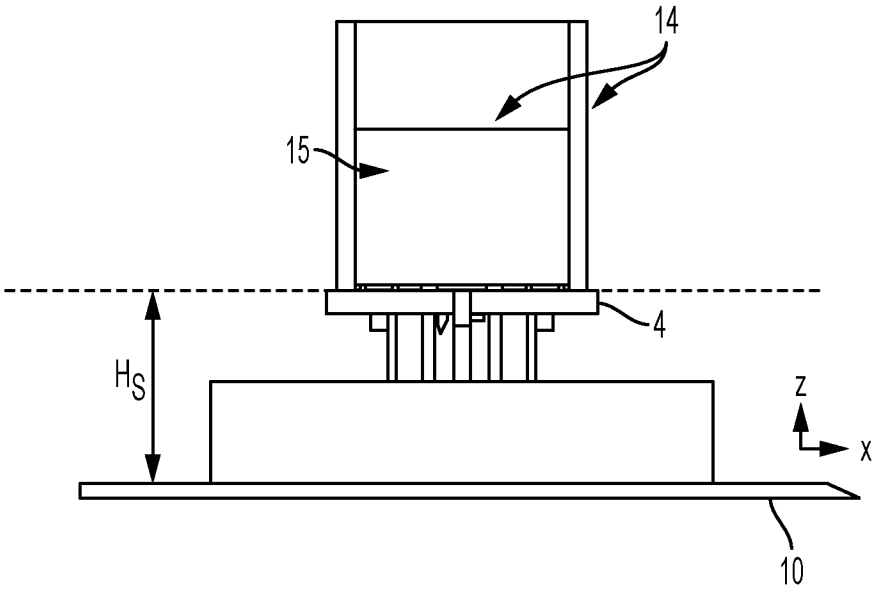
FIG. 12: a further embodiment of a cellular radio antenna in accordance with the invention with a metallic element and/or a metallic coating.

In addition, the following adaptations are conceivable to influence the radiation properties:

The height $H_S$ of the dipole or of the dipole segments 4 above the reflector 10 is drawn in FIG. 12. As is known, the reflector in this respect has the highest directivity effect for frequencies to whose wavelengths λ the relationship $H_S=\lambda/4$ applies.

The directivity effect of the dielectric body furthermore depends, as shown above, on the maximum thickness D or on the diameter of the dielectric body. In accordance with the invention, the spacing $H_S$ between the dipole and the reflector can now be configured ideally for low frequencies, while the maximum thickness D or the diameter of the dielectric cone is designed ideally for high frequencies.

The radiation properties of the antenna can furthermore be influenced by the use of metallic and/or conductive objects in the region of the dielectric body. One or more metal disks or plates 14 can thus, for example, be attached in the dielectric body or at the dielectric body. In this respect, a metal disk that stands perpendicular on the main radiation direction can in particular be integrated into the dielectric body or can be attached to its lower side. It is alternatively or additionally conceivable to equip the surface of the dielectric body with a surface metallization 15. The surface metallization 15 is in this respect preferably only arranged at the outer periphery of the dielectric body. The directive effect of the antenna can also be influenced by such metallic and/or conductive elements. The electrical and conductive elements are preferably adapted in this respect such that its directivity effect is ideal for a different frequency range than the directivity effect of the spacing $H_S$ between the dipole and the reflector, and/or the directivity effect of the dielectric body.

Figure 13:
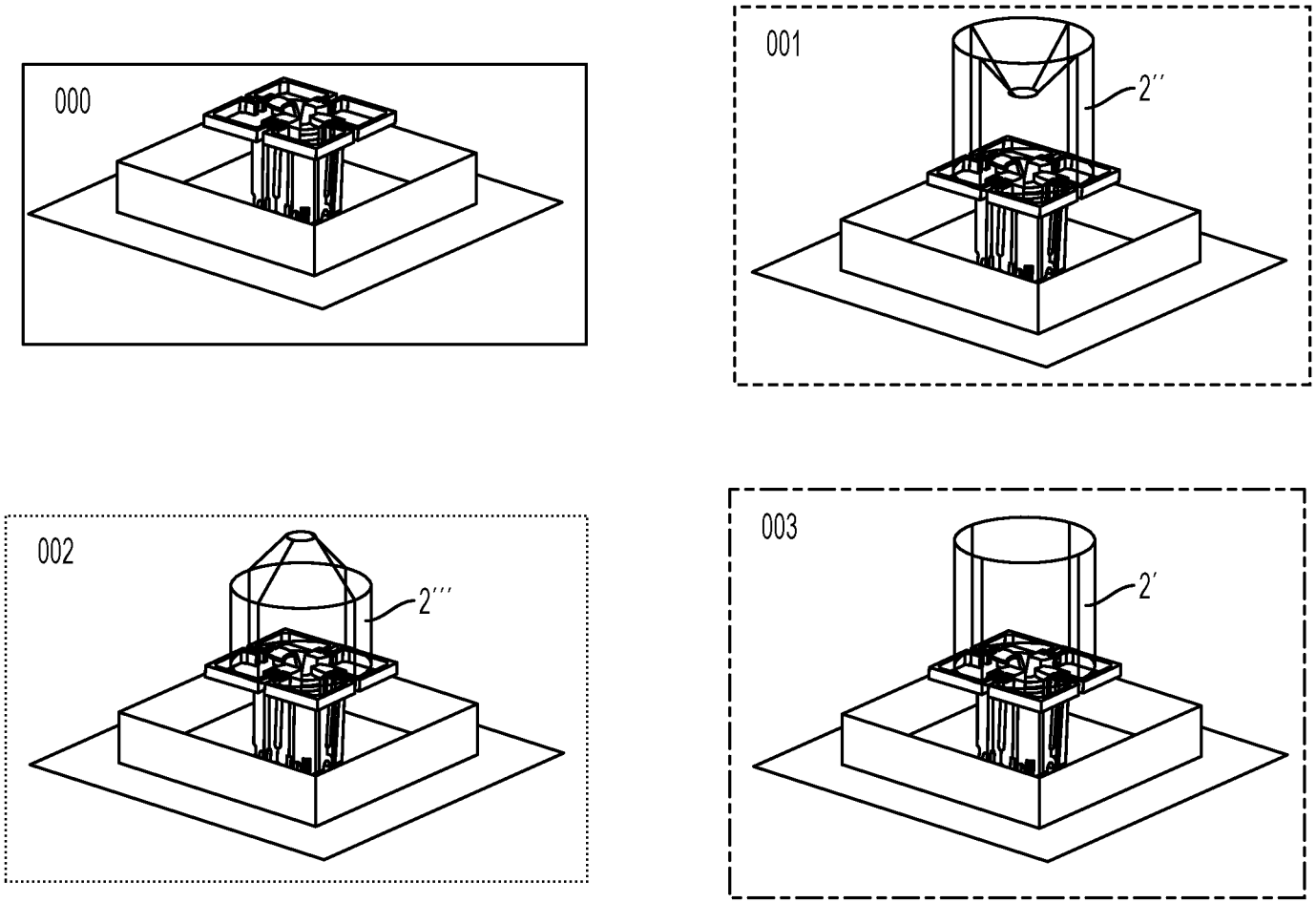
FIG. 13: a cellular radio antenna in accordance with the prior art and three embodiments of cellular radio antennas in accordance with the invention whose dielectric bodies differ with respect to the configuration of the lens region.

The influence of the lens region will be examined again in more detail with reference to FIGS. 13 and 14. Four embodiments 000 to 003 are shown in FIG. 13. The embodiment 000 is in this respect a comparative example without a dielectric body. The embodiment 001 has a lens region designed as a counter-cone; the embodiment 0002 a lens region designed as a cone; and the embodiment 003 is designed without a lens region.

Figure 14A:
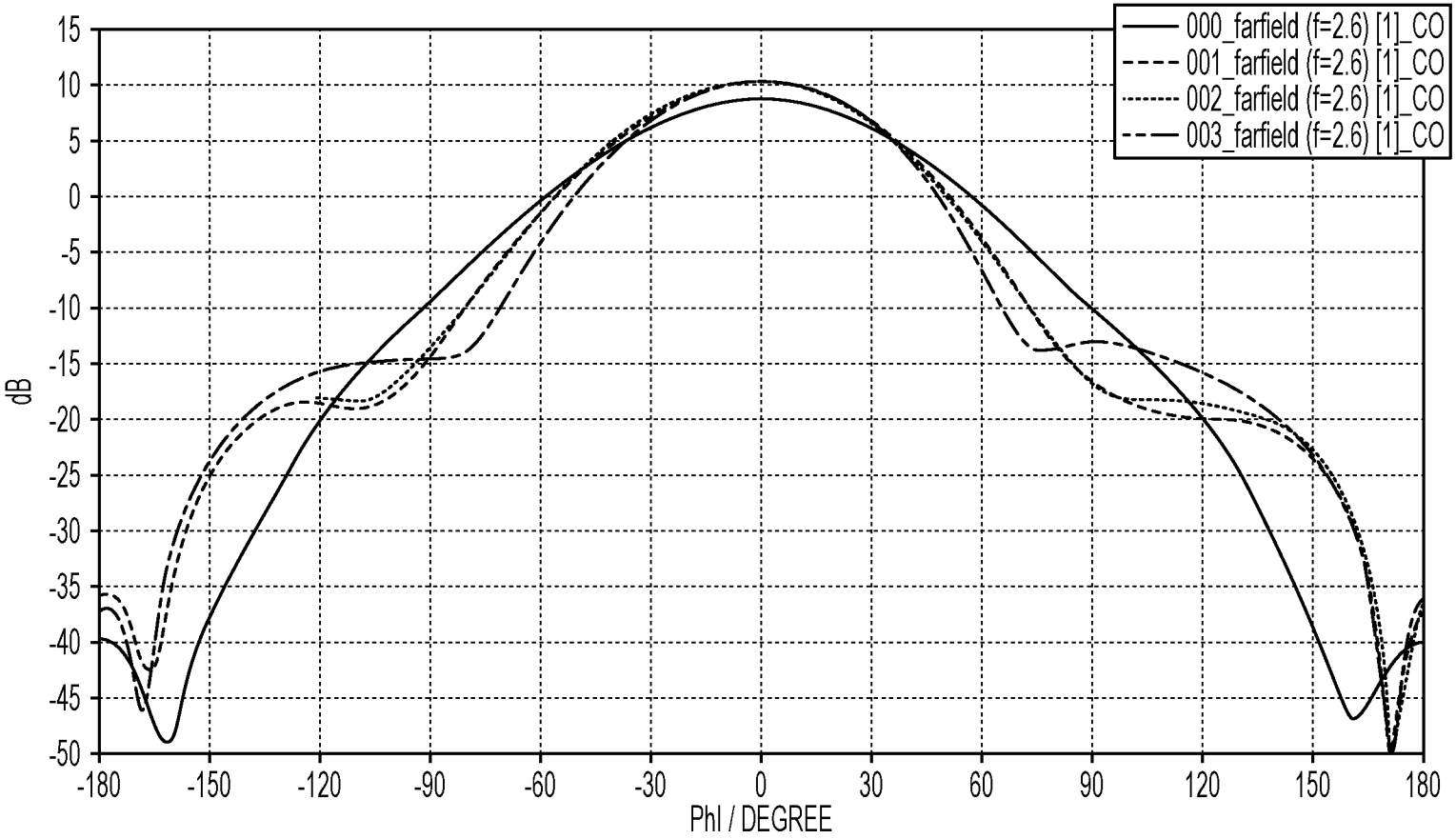
FIG. 14A: a diagram reproducing the far-field working polarization at a frequency of 2.6 GHz for the cellular radio antennas shown in FIG. 13.
Figure 14B:
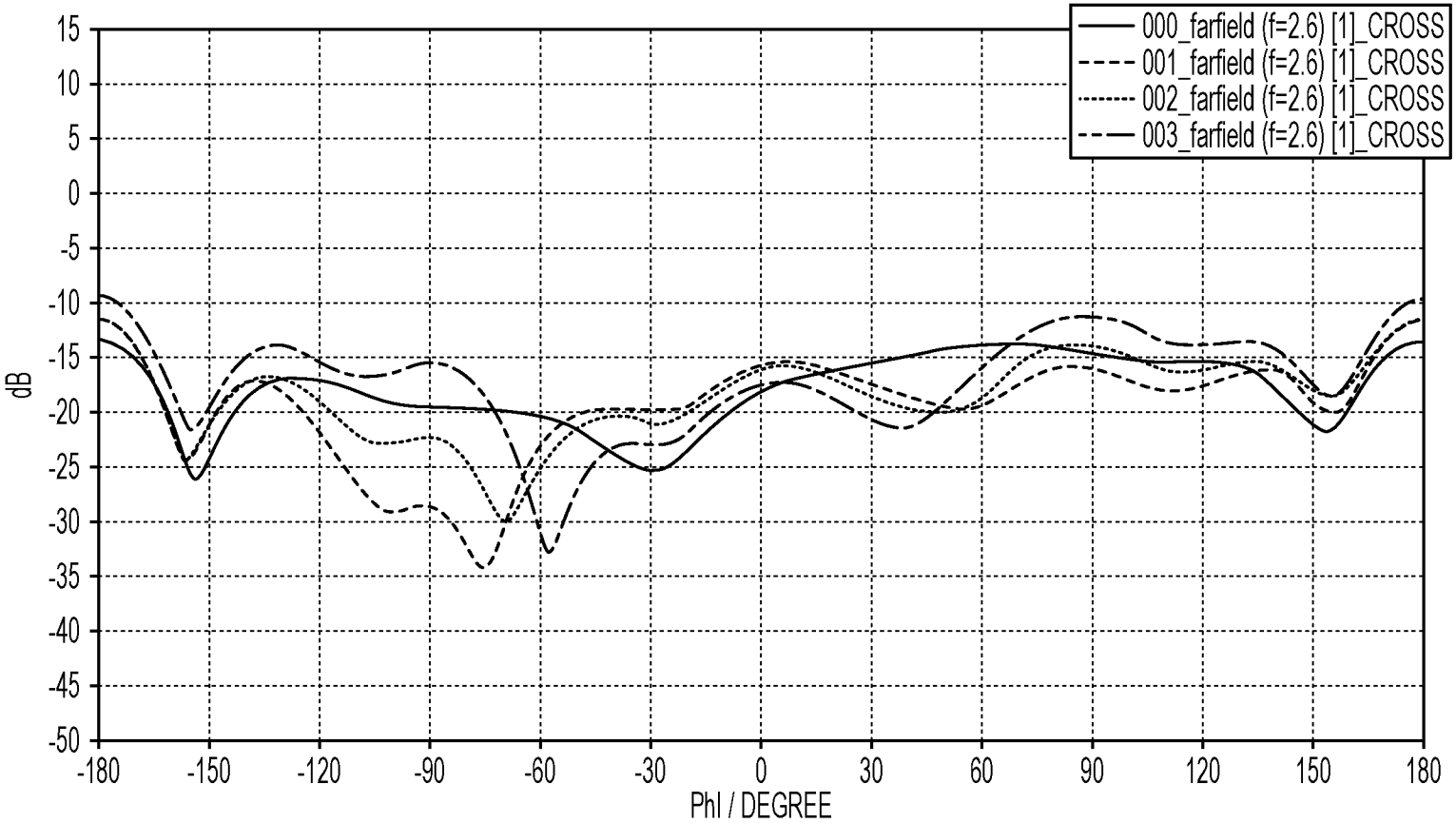
FIG. 14B: a diagram reproducing the far-field cross-polarization at a frequency of 2.6 GHz for the cellular radio antennas shown in FIG. 13.

FIG. 14A shows the far-field diagram of the antenna for the working polarization; FIG. 14B for the cross-polarization. It can be seen in this respect that, as already shown above by the use of the dielectric body, the directivity and the gain in the radiation direction can be increased. The different lens shapes for the examples 001 and 002, however, have as good as no influence at all on the diagrams. The slightly different design of the diagram for the example 003 can probably be explained more due to the greater effective height H of the dielectric body and the already above-discussed amplification of the secondary maxima at larger heights.

The change in accordance with the invention of the radiation plane can in particular be utilized with group antenna arrangements having a high radiator density to change the far-field characteristic. The dielectric bodies in accordance with the invention are in this respect in particular only used with some of the antennas such that their radiation plane is displaced to a height that is in a preferred relation with the radiation plane of the remaining radiators.

Figure 15:
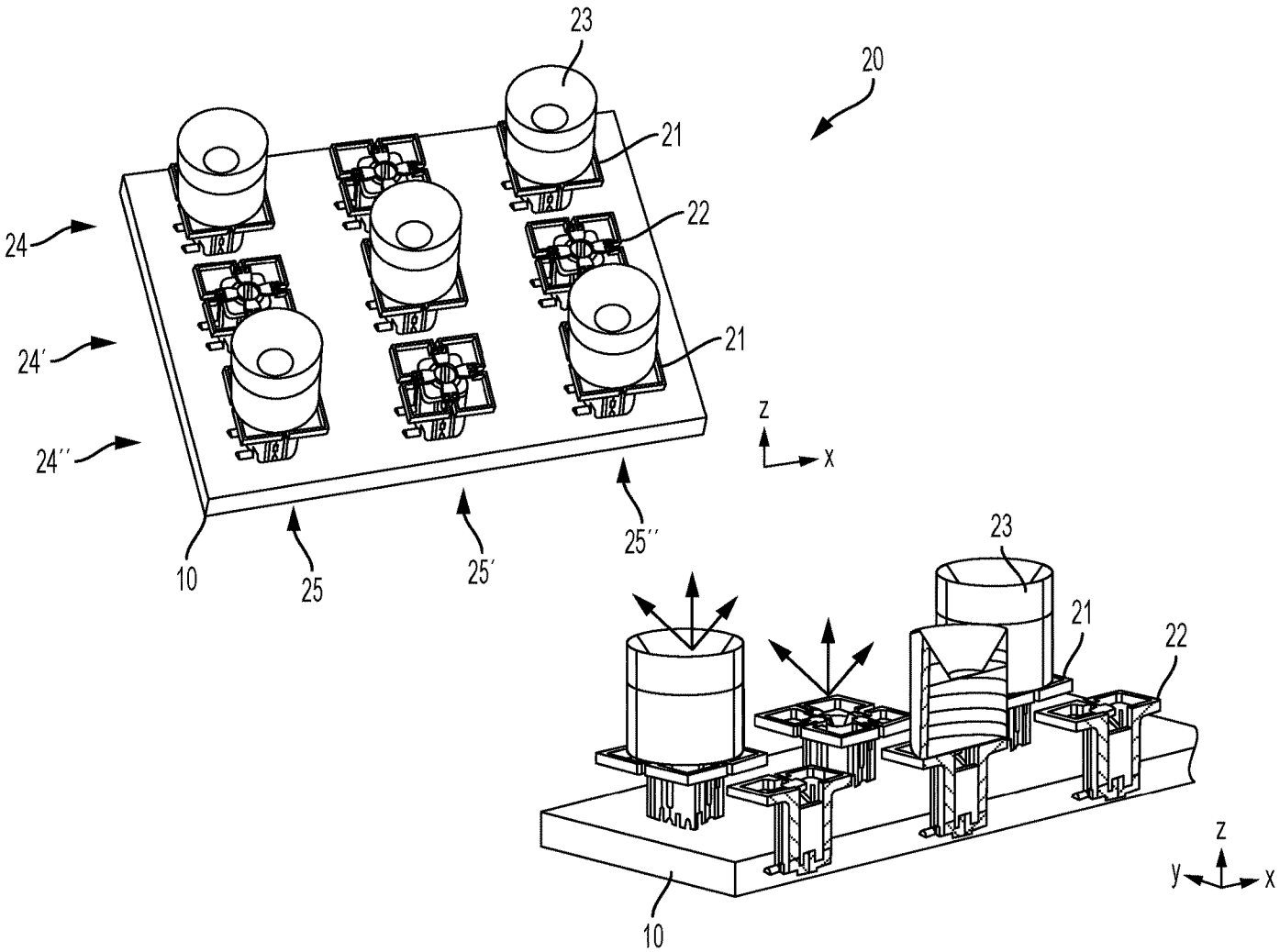
FIG. 15: a first embodiment of an antenna arrangement in accordance with the invention.

FIG. 15 shows a first embodiment of a cellular radio antenna arrangement having a first group of first antennas 21 that are configured as antennas in accordance with the invention and comprise a dipole radiator having a dielectric body 23 and a second subgroup of second antennas 22 that do not have any dielectric bodies. In the embodiment, the dipole radiators of the first antennas 21 and of the second antennas 22 are of identical design. The radiation plane of these antennas is displaced with respect to the second antennas by the use of the dielectric bodies 23 in the first antennas 21.

The dipole radiators of the first antennas and of the second antennas are arranged on a common reflector 10 and would therefore have the same radiation plane without the dielectric bodies 23. The displacement of the aperture or of the radiation plane of the individual radiators therefore reduces the mutual coupling of the individual antennas. The near-field coupling and consequently the far-field values such as the opening angle and the directional effect of the antenna can hereby be improved.

In the embodiment, the antenna arrangement has a plurality of rows 24, 24', 24" and a plurality of columns 25, 25', 25". The first antennas 21 having a dielectric body 23 and the second antennas 22 without such a dielectric body alternate in this respect both in the rows and in the columns.

Figure 16:
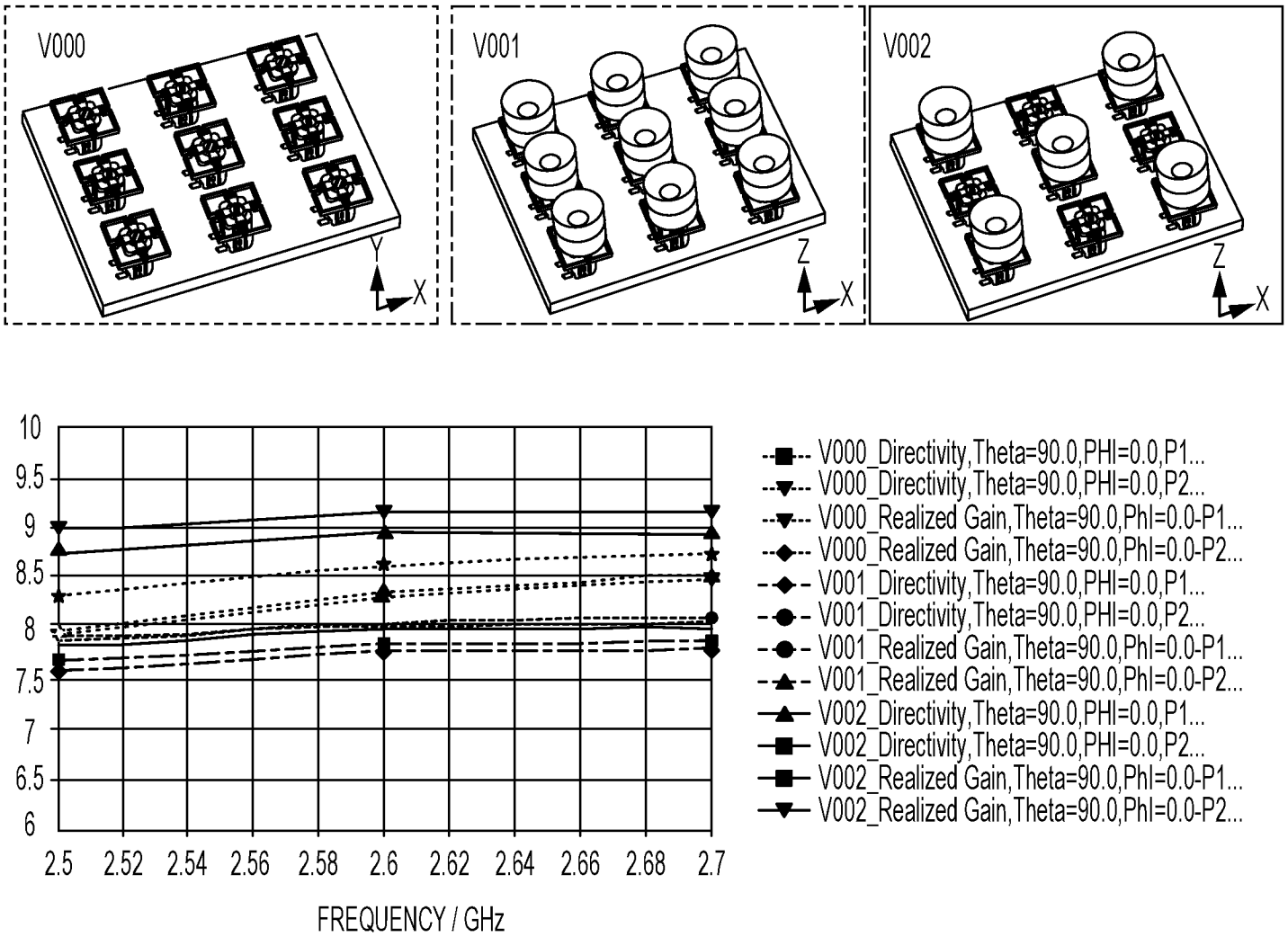
FIG. 16: the first embodiment of an antenna arrangement in accordance with the invention shown in FIG. 15 with two comparison antenna arrangements and a diagram that reproduces the gain for the antenna arrangements in dependence on the frequency.

FIG. 16 shows as a comparison example V000 an antenna arrangement in which all the antennas are designed without dielectric bodies and as comparison example V0001 an embodiment in which all the antennas have a dielectric body. The embodiment of the antenna arrangement in accordance with the invention shown in FIG. 15 is shown as example V002.

Figure 17:
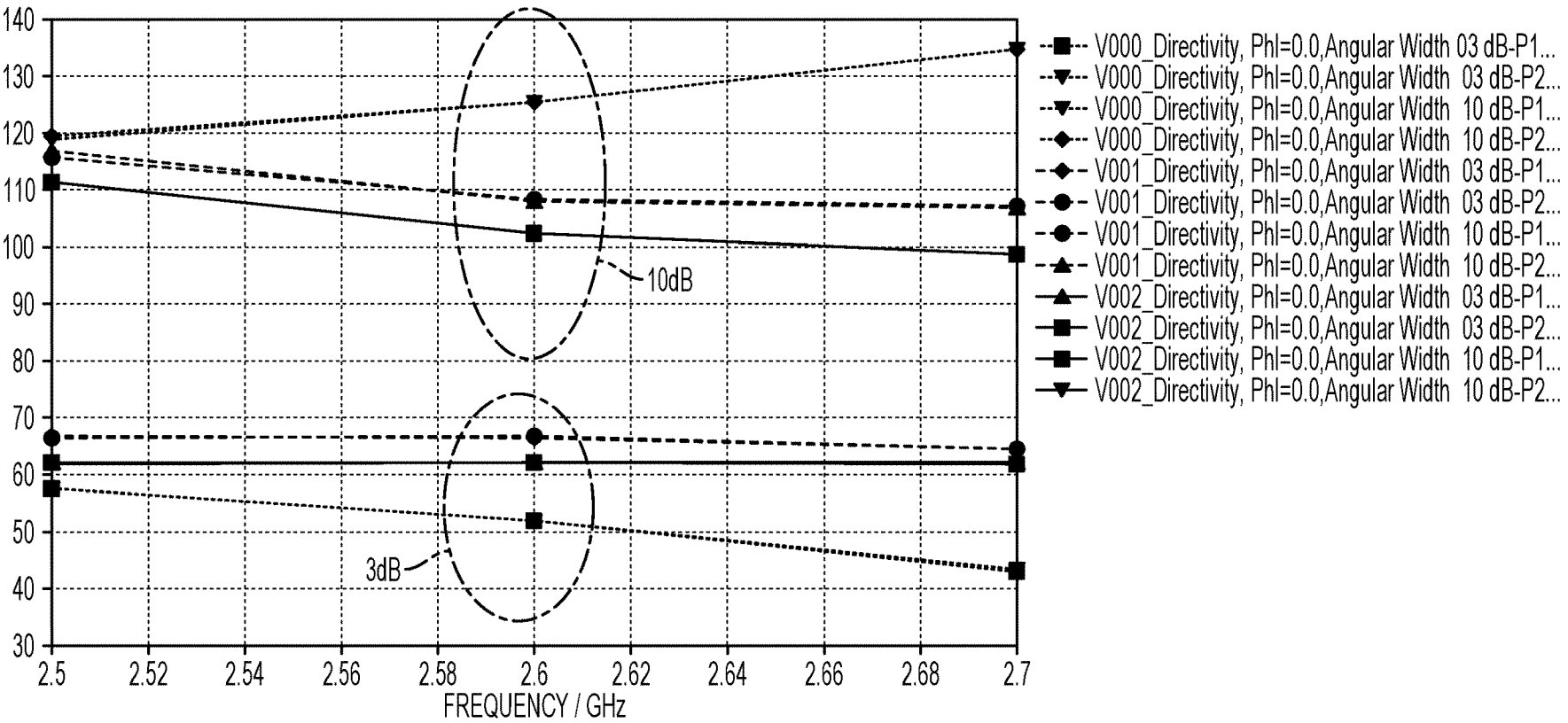
FIG. 17: two diagrams reproducing the directivity of the antenna arrangements shown in FIG. 16, with the width being reproduced at 3 dB and 10 dB in dependence on the frequency.

The directivity and the gain of the individual examples are shown in dependence on the frequency at the bottom of FIG. 16. The width of the far-field diagram is shown at 10 dB and 3 dB in FIG. 17. As can clearly be recognized from both diagrams, the embodiment in accordance with the invention has both the best directivity, at least in the region of the main lobe, and the best gain, in the region of the main lobe.

In the embodiment shown in FIG. 15, the first and second antennas can together be configured as a group antenna. In this respect, a row or a column of antennas can in particular be connected via a phase shifter to a common port or to two common ports, since they are dual-polarized antennas. In this case, a phase equalization preferably takes place between the first and second antennas of such a group antenna to equalize the effects of the dielectric body on the phase position within the group antenna.

Alternatively, however, the first antennas can also form one or more group antennas among one another while the second antennas each form one or more separate group antennas among one another. In this case, the first antennas within a column or a row are preferably connected to one or more common ports via a phase shifter and the second antennas within a column or a row are connected to one or more ports via one or more phase shifters.

In a further embodiment, the individual antennas can also each have separate ports in order, for example, to be able to be flexibly interconnected for beam-forming or beam-shaping applications or to be separately operable. The antenna arrangement is in this case preferably an active antenna arrangement in which a separate amplifier is associated with each of the individual antennas.

The antenna arrangement in accordance with the invention can, however, also be a passive antenna without an amplifier.

In the embodiment of a cellular radio antenna arrangement in accordance with the invention shown in FIG. 15 dual-polarized dipole radiators are used as radiators. These antennas are in this respect in particular designed such as has already been shown in more detail above with respect to the embodiment shown in FIG. 1. The first and the second antennas differ in the embodiment only by the use of a dielectric body in accordance with the present invention in the first antennas, while the dipole radiators are of identical design. The dielectric bodies are in this respect preferably designed such as has already been described above.

Figure 18:
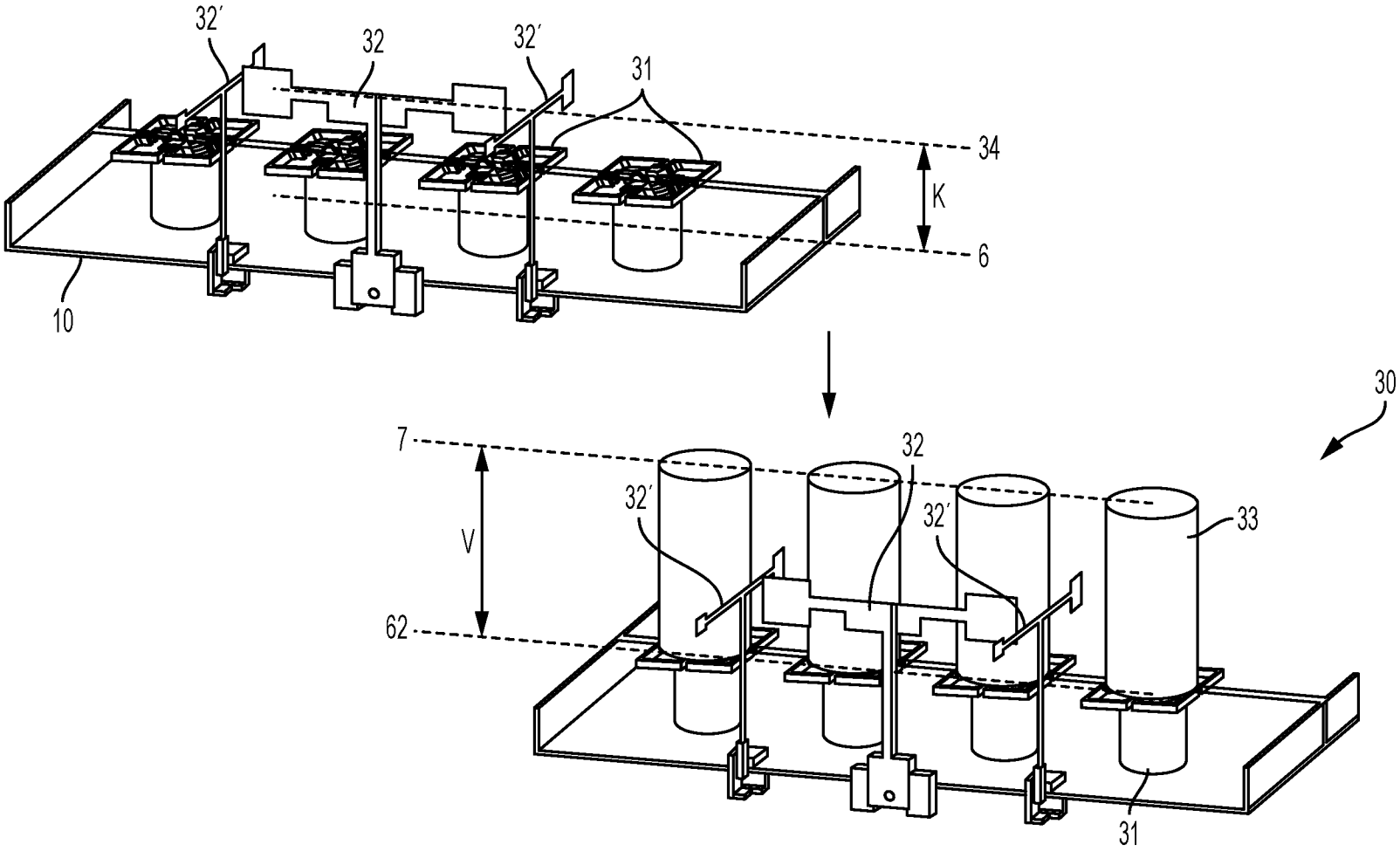
FIG. 18: a second embodiment of an antenna arrangement in accordance with the invention.

In FIG. 18, a second embodiment of an antenna arrangement in accordance with the invention is shown.

An antenna in accordance with the prior art is first shown at the top in FIG. 18. It has first antennas 31 and second antennas 32. The first antennas are used for the transmission and/or reception in a higher frequency band; the second antennas 32 for the transmission and/or reception in a lower frequency band. The first antennas and the second antennas are in this respect each dipole radiators. Since the dipole radiators of the second antennas are adapted for lower frequencies, they have a greater spacing from the common reflector 10 than the dipole radiators of the first antennas. The radiation plane 6 of the first antennas 31 is thus below the plane 34 of the dipole segments of the second antennas. This has the result in the prior art that the radiation power of the first antennas is substantially impaired.

This effect is prevented in accordance with the invention in that, with an otherwise identical structure, dielectric bodies 33 are arranged on the first antennas 31, said dielectric bodies raising the radiation plane of the first antennas 31 from the radiation plane 6 of their dipole radiators above the plane 34 of the dipole segments of the second antennas 32. The radiation characteristic of the first antennas 31 is hereby no longer negatively influenced by the presence of the second antennas. The displacement V and equivalently the height H of the dielectric bodies 33 is thus larger in this embodiment than the spacing K between the radiation plane 6 of the dipole radiators of the first antennas 31 and the radiation plane 34 of the dipole radiators of the second antennas.

In the embodiment shown in FIG. 18, the dipole radiators of the first antennas are in turn dual-polarized dipole radiators. They are in particular designed such as has already been shown above with respect to the embodiment shown in FIG. 1.

The dipoles of the second antennas 32 are in contrast configured as VH pole, i.e. dipoles 32 and 32' are used that are spaced apart from one another and that each have polarizations orthogonal to one another. They are interconnected to form an X pole via a 180° hybrid coupler.

The second antennas can in this respect, for example, be used as low-band antenna for the cellular radio frequency band between 698 and 960 MHz; the first antennas as high-band antennas for the frequency range between 1710 and 2690 MHz.

Figure 19:
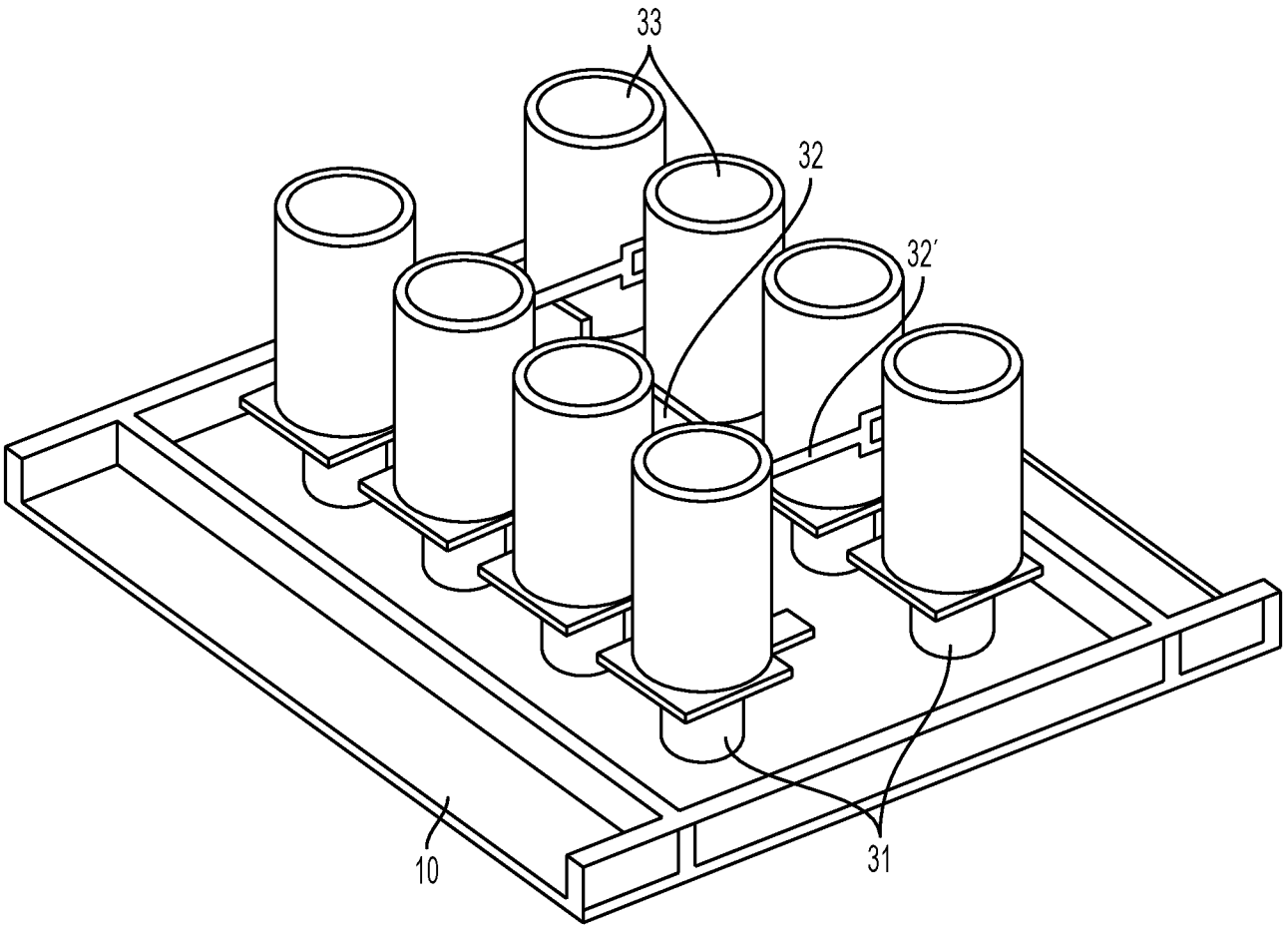
FIG. 19: a perspective representation of the second embodiment shown in FIG. 18.

As shown in FIG. 19, which reproduces the embodiment shown in FIG. 18 again in a perspective view, the first antennas are in this respect arranged in four columns of two antennas each, with the second antennas being arranged between the rows formed in this manner.

The dipoles of the second antennas 32 can also be arranged in a square, with a respective first antenna 31 being located within such a square. Further first antennas 31 can furthermore be arranged between such squares of second antennas 32. Alternatively or additionally, the second antennas 32 can also be arranged in the form of a cross.

Figure 20:
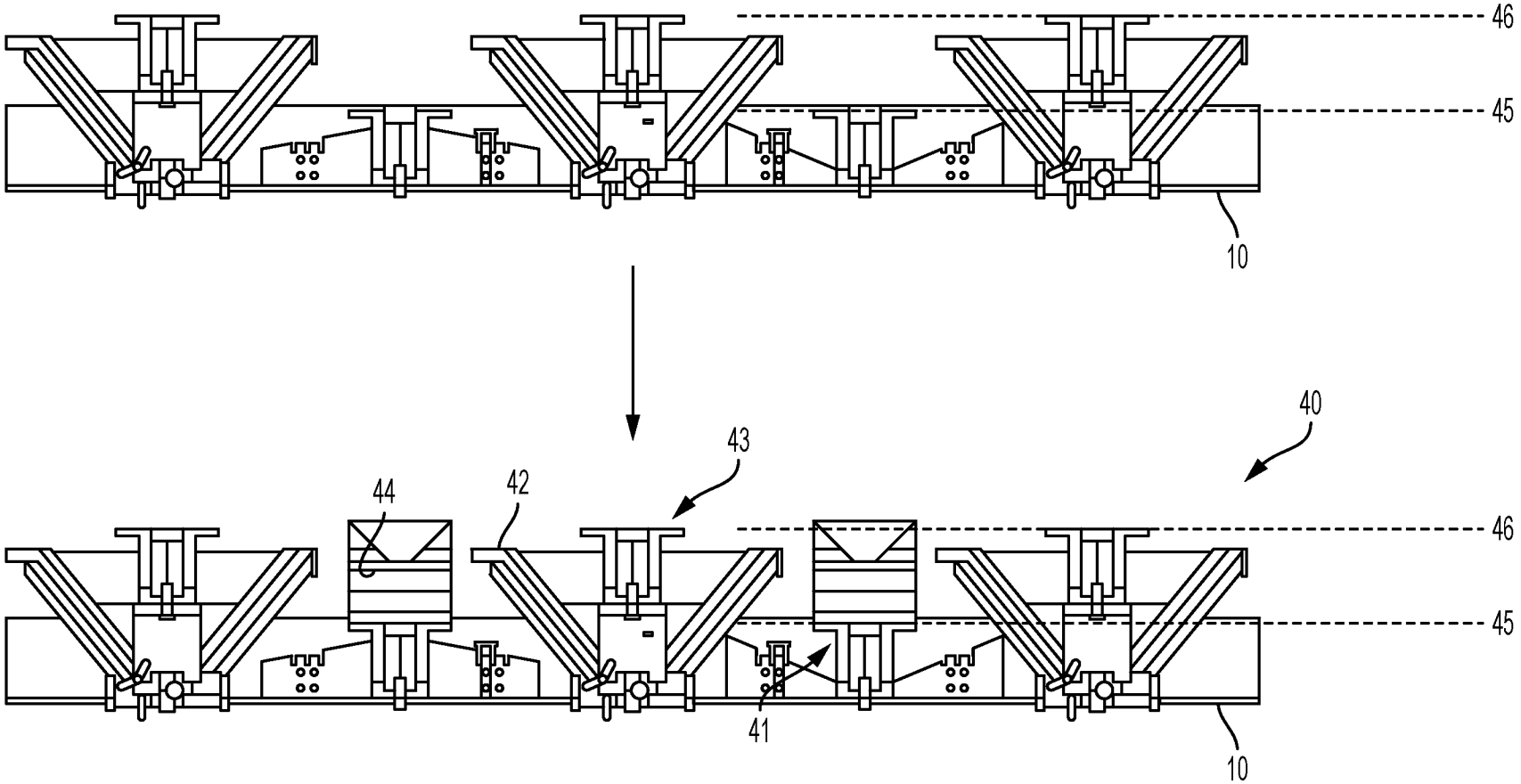
FIG. 20: a third embodiment of an antenna arrangement in accordance with the invention.
Figure 21:
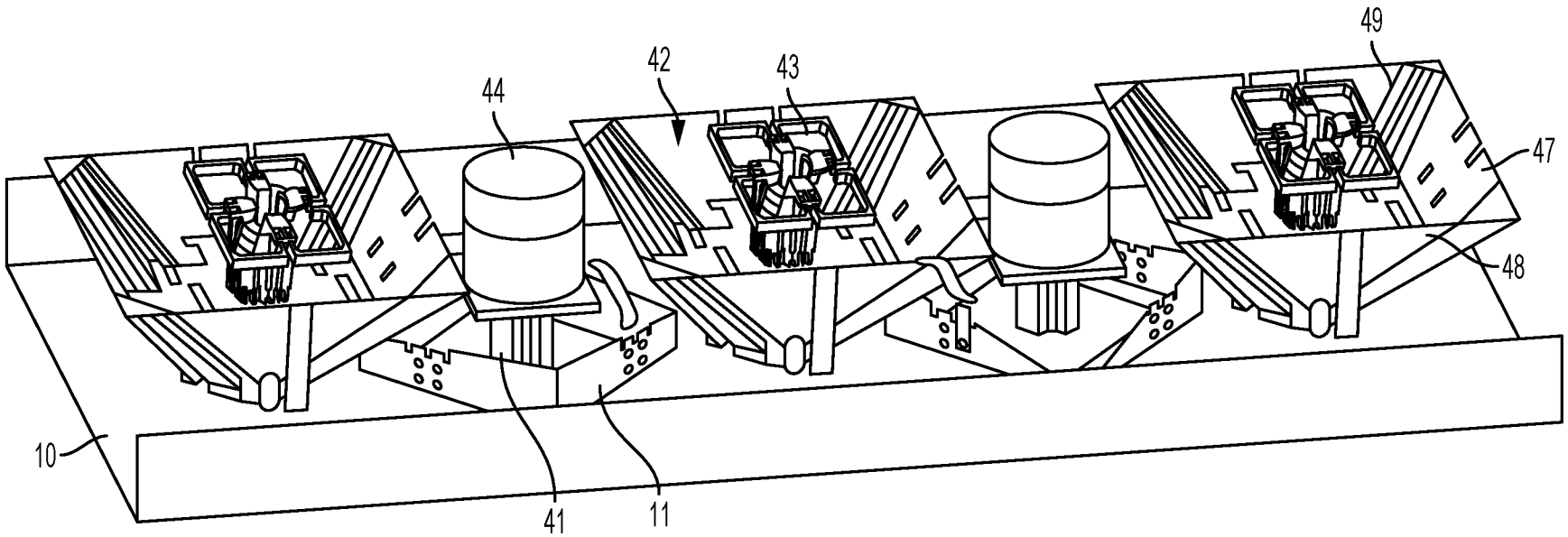
FIG. 21: a perspective representation of the third embodiment of an antenna arrangement shown in FIG. 20.

A third embodiment of an antenna arrangement in accordance with the invention is shown in FIGS. 20 and 21. An antenna in accordance with the prior art is again shown at the top in FIG. 20, while the embodiment of the present invention equipped with dielectric bodies is shown at the bottom.

The antenna arrangement in accordance with the invention has first antennas 41, second antennas 42, and third antennas 43. The first antennas 41 and the third antennas 43 are used for transmission in the same frequency band; the second antennas 42 in contrast for transmission in a lower frequency band.

In this respect, the third antennas 43 are arranged in the region of the second antennas 42 and are upwardly offset in the radiation direction with respect to the first antennas 41. The second antennas 42 moreover have metal elements that extend up to and into a plane above the radiation plane 45 of the dipole radiators of the first antennas 41.

In the embodiment, the second antennas are in this respect antennas having side walls 47 and 48 that extend obliquely to the main radiation direction and between which slots 49 are formed that act as slot radiators. The obliquely extending side walls 47 and 48 in this respect together form a type of funnel. The dipole radiators of the first antennas 41 are arranged between these funnel-like antennas. Alternatively, the second antennas could also comprise dipole radiators that are arranged in a square.

In an antenna in accordance with the prior art, the radiation of the first antennas is therefore impaired by the metallic elements of the second antennas 42 arranged at the top in the radiation direction. The dipole radiators of the first antennas 41 and the dipole radiators of the third antennas 43 furthermore have different radiation planes 45 and 46.

Both problems are remedied in accordance with the invention by the use of dielectric bodies 44 on the dipole radiators of the first antennas 41. The height H of the dielectric bodies in this respect corresponds to the spacing between the radiation plane 46 of the dipole radiators of the third antennas and the radiation plane 45 of the dipole radiators of the first antennas.

This has the effect, on the one hand, that the first and third antennas have substantially the same radiation plane. The radiation plane of the first antennas is furthermore raised above the plane of the metallic elements of the second antennas so that their radiation properties are no longer negatively influenced.

The dipole radiators of the first and third antennas can be dual-polarized dipole radiators. The dipoles of the two polarizations are in this respect arranged crossed over one another. The dipole radiators can in this respect be designed such as was described in more detail with respect to the embodiment in FIG. 1.

The dipole radiators of the first and third antennas can be of the same construction design and/or can have the same resonant frequency ranges. They typically only have slight differences in the base region with respect to their fastening.

The first and third antennas are preferably used for transmitting and/or receiving in the same frequency band. The first and third antennas can in this respect be interconnected to form one or more group antennas and can in particular be connected to one or more common ports via one or more phase shifters.

The second antennas are preferably used for transmission and/or reception in a lower frequency band than the first and/or third antennas. The second antennas are preferably interconnected to form one or more group antennas and can in particular be connected to one or more ports via one or more phase shifters.

The second antennas 42 and the first antennas 41 are arranged on a common reflector 10. The third antennas are arranged within the second antennas and preferably have their own subreflector that is likewise arranged within the second antennas 42. The first antennas can furthermore have frame-shaped subreflectors 11.

Independently of the specific configuration, those antennas are preferably used as first antennas in the cellular radio antenna arrangements of in accordance with the invention such as were already described in more detail above with respect to the antennas in accordance with the invention. This in particular applies to the dimensioning and/or to the configuration of the dielectric bodies.

The invention claimed is:

1. A cellular radio antenna comprising at least one dipole radiator and having a dielectric body arranged on the dipole radiator, wherein a height of the dielectric body in a main radiation direction amounts to at least 30% of a maximum thickness of the dielectric body in a cross-section perpendicular to the main radiation direction, wherein the cellular radio antenna is for a cellular radio base station, wherein there is the following relationship for the maximum thickness D of the dielectric body and the height H of the dielectric body with respect to a wavelength λ of a center frequency of a lowest resonant frequency range of the cellular radio antenna and an effective relative permittivity $\varepsilon_r$ of the dielectric body:

$$0.5*\left(\frac{\lambda}{\sqrt{\pi(\varepsilon_r-1)}}\right)\leq H$$

and/or $$0.5*\left(\frac{\lambda}{\sqrt{\pi(\varepsilon_r-1)}}\right)\leq D\leq 2.5*\left(\frac{\lambda}{\sqrt{\pi(\varepsilon_r-1)}}\right).$$

2. The cellular radio antenna in accordance with claim 1, wherein the height of the dielectric body amounts to at least 50% of the maximum thickness of the dielectric body; and/or wherein the dielectric body has an effective relative permittivity $\varepsilon_r>2$.

3. The cellular radio antenna in accordance with claim 1, wherein the dipole radiator is a dual-polarized dipole radiator; and/or wherein the dielectric body has an axis of symmetry facing in the main radiation direction, with it being an axial symmetry and/or a rotational symmetry; and/or wherein the dielectric body has a rod region and/or a lens region, with a height of the rod region amounting to between 50% and 100% of the height of the dielectric body; and/or wherein the lens region is arranged on a side of the rod region remote from the dipole radiator; and/or wherein a height of the lens region amounts to between 5% and 50% of the height of the dielectric body.

4. The cellular radio antenna in accordance with claim 1, wherein a conductive and/or metallic element is arranged in and/or at the dielectric body, with the conductive and/or metallic element being a coating of an inner or outer surface of the dielectric body and/or a conductive and/or metallic disk arranged in or at the dielectric body;

and/or wherein the conductive and/or metallic element surrounds an outer periphery of the dielectric body or extends in a plane perpendicular to the main radiation direction;

wherein the conductive and/or metallic element has a directivity effect that is at a maximum for a frequency $f_{met}$, and wherein the dielectric body has a directivity effect that is at a maximum for a frequency $f_{diel}$, where $f_{met} \neq f_{diel}$;

and/or wherein there is the following relationship with respect to the center frequency $f_{res}$ of the lowest resonant frequency range of the cellular radio antenna: $f_{met} < f_{res} < f_{diel}$, and/or wherein $|f_{diel} - f_{met}|/f_{diel} > 0.1 * f_{diel}$.

5. A cellular radio antenna comprising at least one dipole radiator, a dielectric body arranged on the dipole radiator, and a reflector on which the dipole radiator is arranged, wherein a height of the dielectric body in a main radiation direction amounts to at least 30% of a maximum thickness of the dielectric body in a cross-section perpendicular to the main radiation direction, wherein the cellular radio antenna is for a cellular radio base station, wherein the cellular radio antenna has a subreflector that is configured as a reflector frame, with an edge length of the reflector frame being the same as or larger than the maximum thickness of the dielectric body;

and/or wherein a spacing between the reflector and the dipole radiator amounts to between 0.05λ and 0.5λ, with λ being a wavelength of a center frequency of a lowest resonant frequency range of the cellular radio antenna;

and/or wherein the reflector has a directivity effect that is at a maximum for a frequency $f_{ref}$, and wherein the dielectric body has a directivity effect that is at a maximum for a frequency $f_{diel}$, where $f_{met} \neq f_{diel}$;

and/or wherein there is the following relationship with respect to the center frequency $f_{res}$ of the lowest resonant frequency range of the antenna: $f_{ref} < f_{res} < f_{diel}$, and/or wherein $|f_{diel} - f_{met}|/f_{diel} > 0.1 * f_{diel}$.

6. A cellular radio antenna arrangement comprising a plurality of antennas, having a first subgroup of one or more first antennas and a second subgroup of one or more second antennas, wherein the first antennas each comprise a dipole radiator having a first dielectric body arranged on the dipole radiator, wherein a height of the first dielectric body amounts to at least 30% of a maximum thickness of the first dielectric body; and wherein the second antennas each comprise a radiator without a dielectric element or with a different, second dielectric body.

7. The cellular radio antenna arrangement in accordance with claim 6, wherein the dipole radiators of the first antennas are dual-polarized dipole radiators; and/or wherein the radiators of the second antennas are dual-polarized radiators and/or dipole radiators.

8. The cellular radio antenna arrangement in accordance with claim 6, wherein the dipole radiators of the first antennas have identical resonant frequency ranges and/or have a same radiation plane and/or height above a common reflector; and/or wherein the radiators of the second antennas have identical resonant frequency ranges and/or have a same radiation plane and/or height above a common reflector; and/or wherein the first dielectric bodies have a same height; and/or wherein the second dielectric bodies have a same height.

9. The cellular radio antenna arrangement in accordance with claim 6, wherein the first dielectric bodies displace radiation planes of the first antennas and of the second antennas away from one another, with the dipole radiators of the first antennas and the radiators of the second antennas being arranged in a common plane and/or having a same height $H_s$ above a common reflector, with a displacement V of the radiation planes and the height $H_s$ of the dipole radiators of the first antennas above a common reflector having the following relationship: $0.5\ H_S < V$; and/or wherein the dipole radiators of the first antennas and the radiators of the second antennas have a same resonant frequency range and/or are of a same structure.

10. The cellular radio antenna arrangement in accordance with claim 6, wherein the first dielectric bodies move radiation planes of the first antennas and of the second antennas toward one another, with the dipole radiators of the first antennas and the radiators of the second antennas being arranged in different planes and/or having different heights and above a common reflector, with a remaining spacing A between the radiation planes having the following relationship with respect to a height $H_{S1}$ of the dipole radiators of the first antennas above a common reflector: $A < 0.5\ H_{S1}$; and/or wherein the dipole radiators of the first antennas and the radiators of the second antennas have a same resonant frequency range and/or are of a same structure.

11. The cellular radio antenna arrangement in accordance with claim 6, wherein the dipole radiators of the first antennas are arranged in a first plane and the second antennas have metal structures that are arranged in a second plane above the first plane; wherein the first dielectric bodies extend at least up to the second plane of the metal structures of the second antennas and/or raise a radiation plane of the dipole radiators of the first antennas at least to the second plane; and/or wherein a height of the dipole radiators of the first antennas above a common reflector is smaller than a height of the radiators of the second antennas above a common reflector; and/or wherein a center frequency of a lowest resonant frequency range of the dipole radiators of the first antennas is higher than a center frequency of a lowest resonant frequency range of the radiators of the second antennas.

12. The cellular radio antenna arrangement in accordance with claim 11, wherein the radiators of the second antennas are dipole radiators and are arranged in a plane above the first plane of the dipole radiators of the first antennas, with the dipole radiators of the first antennas and the radiators of the second antennas having different resonant frequency ranges and/or being used for different frequency bands; and/or wherein the second antennas have a plurality of dipoles that are arranged in a square and/or in a cross and/or in a T;

or wherein third radiators are arranged in a region of the radiators of the second antennas and have a same resonant frequency range and/or are used for a same frequency band; and/or wherein the dipole radiators of the first antennas and the radiators of the second antennas have different resonant frequency ranges and/or are used for different frequency bands, with the radiators of the second antennas having radiator elements that extend in parallel with and/or perpendicular to and/or obliquely to a radiation direction, with the third radiators being arranged within the radiator elements extending in parallel with and/or perpendicular to and/or obliquely to the radiation direction, with the third radiators being dual-polarized dipole radiators.

13. The cellular radio antenna arrangement in accordance with claim 6, having at least one column or one row of antennas, wherein the first and second antennas are arranged alternately in the column or row; and/or wherein the second antennas are arranged between two columns or two rows of first antennas.

14. The cellular radio antenna arrangement in accordance with claim 6, wherein the first antennas are formed by cellular radio antennas having at least one dipole radiator and having a dielectric body arranged on the dipole radiator, wherein a height of the dielectric body in a main radiation direction amounts to at least 30% of a maximum thickness of the dielectric body in a cross-section perpendicular to the main radiation direction; and wherein the cellular radio antenna is for a cellular radio base station.

15. The cellular radio antenna in accordance with claim 2, wherein the height of the dielectric body amounts to at least 70% of the maximum thickness of the dielectric body; and/or wherein the dielectric body has an effective relative permittivity $\varepsilon_r > 2.5$.

16. The cellular radio antenna in accordance with claim 1, wherein:

$$0.75 * \left( \frac{\lambda}{\sqrt{\pi(\varepsilon_r - 1)}} \right) \leq H$$

and/or $$0.75 * \left( \frac{\lambda}{\sqrt{\pi(\varepsilon_r - 1)}} \right) \leq D \leq 2.5 * \left( \frac{\lambda}{\sqrt{\pi(\varepsilon_r - 1)}} \right) \text{ or } \leq 1.25 * \left( \frac{\lambda}{\sqrt{\pi(\varepsilon_r - 1)}} \right).$$

17. The cellular radio antenna in accordance with claim 5, wherein the spacing between the reflector and the dipole radiator amounts to between $0.1\lambda$ and $0.4\lambda$;

and/or wherein $f_{ret} < f_{diel}$;

and/or wherein $|f_{diel} - f_{met}| / f_{diel} > 0.2 * f_{diel}$.

18. The cellular radio antenna arrangement in accordance with claim 10, wherein: $A < 0.2$ HS1.

19. The cellular radio antenna arrangement in accordance with claim 13, wherein the plurality of antennas has a plurality of columns and rows; wherein the first and second antennas are arranged respectively alternately in the plurality of columns and rows; and/or wherein the second antennas are arranged between a plurality of columns and rows of first antennas.

* * * * *